US008956795B2

(12) United States Patent
Kojima et al.

(10) Patent No.: US 8,956,795 B2
(45) Date of Patent: Feb. 17, 2015

(54) TONER FOR DEVELOPING ELECTROSTATIC IMAGE, TWO-COMPONENT DEVELOPER AND IMAGE FORMING APPARATUS

(71) Applicants: Satoshi Kojima, Shizuoka (JP); Tsuneyasu Nagatomo, Shizuoka (JP); Syouko Satoh, Miyagi (JP); Osamu Uchinokura, Shizuoka (JP); Junichi Awamura, Shizuoka (JP); Satoshi Ogawa, Nara (JP); Takahiro Honda, Shizuoka (JP); Daisuke Ito, Kanagawa (JP); Teruki Kusahara, Shizuoka (JP); Masaki Watanabe, Shizuoka (JP); Daisuke Inoue, Shizuoka (JP); Kiwako Hirohara, Miyagi (JP)

(72) Inventors: Satoshi Kojima, Shizuoka (JP); Tsuneyasu Nagatomo, Shizuoka (JP); Syouko Satoh, Miyagi (JP); Osamu Uchinokura, Shizuoka (JP); Junichi Awamura, Shizuoka (JP); Satoshi Ogawa, Nara (JP); Takahiro Honda, Shizuoka (JP); Daisuke Ito, Kanagawa (JP); Teruki Kusahara, Shizuoka (JP); Masaki Watanabe, Shizuoka (JP); Daisuke Inoue, Shizuoka (JP); Kiwako Hirohara, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 29 days.

(21) Appl. No.: 13/792,722

(22) Filed: Mar. 11, 2013

(65) Prior Publication Data

US 2013/0244156 A1 Sep. 19, 2013

(30) Foreign Application Priority Data

Mar. 19, 2012 (JP) ..... 2012-061685

(51) Int. Cl.

| | |
|---|---|
| ***G03G 9/08*** | (2006.01) |
| ***G03G 9/087*** | (2006.01) |
| ***G03G 9/097*** | (2006.01) |

(52) U.S. Cl.

CPC ..... *G03G 9/08755* (2013.01); *G03G 9/0804* (2013.01); *G03G 9/0821* (2013.01); *G03G 9/08782* (2013.01); *G03G 9/09708* (2013.01); *G03G 9/09725* (2013.01)

USPC ..... 430/108.1; 430/108.7

(58) Field of Classification Search

CPC ..... G03G 9/09708; G03G 9/09716; G03G 9/09725

USPC ..... 430/108.6, 108.7

See application file for complete search history.

(56) References Cited

U.S. PATENT DOCUMENTS

| | | | | |
|---|---|---|---|---|
| 5,837,414 | A | 11/1998 | Kitani et al. | |
| 2003/0148204 | A1 * | 8/2003 | Ohmura et al. | 430/110.3 |
| 2005/0112488 | A1 * | 5/2005 | Yamada et al. | 430/108.7 |
| 2007/0059625 | A1 * | 3/2007 | Yamamoto et al. | 430/108.6 |
| 2007/0190443 | A1 * | 8/2007 | Hagi et al. | 430/108.6 |
| 2007/0190444 | A1 * | 8/2007 | Kotsugai et al. | 430/108.6 |

(Continued)

FOREIGN PATENT DOCUMENTS

| | | |
|---|---|---|
| JP | 03-100661 | 4/1991 |
| JP | 08-176310 | 7/1996 |

(Continued)

*Primary Examiner* — Hoa V Le

(74) *Attorney, Agent, or Firm* — Oblon, Spivak, McClelland, Maier & Neustadt, L.L.P.

(57) ABSTRACT

A toner for developing an electrostatic image, including: toner base particles each including a binder resin and a releasing agent; and inorganic fine particles, wherein the toner includes the inorganic fine particles as an external additive on a surface of the toner base particle, wherein the toner base particles have a BET specific surface area of 2.5 $m^2/g$ to 5.0 $m^2/g$, and wherein the inorganic fine particles comprise inorganic fine particles (A) which are each a secondary particle where a plurality of primary particles are coalesced together.

10 Claims, 4 Drawing Sheets

(56) References Cited

U.S. PATENT DOCUMENTS

| | | | | |
|---|---|---|---|---|
| 2007/0207399 | A1* | 9/2007 | Kadota et al. | 430/108.4 |
| 2008/0096119 | A1* | 4/2008 | Yamamoto et al. | 430/109.4 |
| 2008/0220357 | A1* | 9/2008 | Nozaki et al. | 430/108.8 |
| 2009/0067876 | A1* | 3/2009 | Seshita et al. | 399/107 |
| 2009/0142682 | A1* | 6/2009 | Saitoh et al. | 430/108.2 |
| 2010/0248110 | A1 | 9/2010 | Taguchi et al. | |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1 | 9/2011 | Sugimoto et al. | |
| 2011/0262853 | A1 | 10/2011 | Watanabe et al. | |
| 2011/0262854 | A1* | 10/2011 | Ikuta | 430/108.6 |
| 2011/0294058 | A1 | 12/2011 | Shiba et al. | |
| 2011/0305986 | A1 | 12/2011 | Ogawa et al. | |
| 2011/0318053 | A1 | 12/2011 | Yamashita et al. | |
| 2012/0021347 | A1 | 1/2012 | Shimota et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0122027 | A1 | 5/2012 | Watanabe et al. | |
| 2012/0148948 | A1* | 6/2012 | Ikeda et al. | 430/108.3 |
| 2012/0219896 | A1 | 8/2012 | Asahina et al. | |
| 2012/0237869 | A1 | 9/2012 | Chiba et al. | |
| 2012/0237870 | A1 | 9/2012 | Watanabe et al. | |
| 2012/0264043 | A1 | 10/2012 | Watanabe et al. | |

FOREIGN PATENT DOCUMENTS

| | | |
|---|---|---|
| JP | 09-319134 | 12/1997 |
| JP | 3030741 | 2/2000 |
| JP | 2000-112174 | 4/2000 |
| JP | 3056122 | 4/2000 |
| JP | 2001-201891 | 7/2001 |
| JP | 2001-235894 | 8/2001 |
| JP | 3328013 | 7/2002 |
| JP | 3684074 | 6/2005 |
| JP | 2010-224502 | 10/2010 |
| JP | 2010-243664 | 10/2010 |

* cited by examiner

TONER FOR DEVELOPING ELECTROSTATIC IMAGE, TWO-COMPONENT DEVELOPER AND IMAGE FORMING APPARATUS

BACKGROUND OF THE INVENTION

1. Field of the Invention

The present invention relates to: a toner used as a developer when an electrostatic image formed by electrophotography, electrostatic recording and so on is developed; a two-component developer including the toner; and an image forming apparatus using the toner.

2. Description of the Related Art

After a charging step which uniformly charges an image-forming region on a surface of an image bearing member, an exposing step which writes on the image bearing member, a developing step which forms an image on the image bearing member by a frictionally charged toner and a transfer step which transfers the image on the image bearing member directly on a printing sheet or indirectly via an intermediate transfer member, an image forming apparatus fixes the image on the printing sheet. Also, a transfer residual toner not transferred on the image bearing member, is scraped from the image bearing member by a cleaning step, and a next image forming process is carried out.

As the developer to be used, there are a two-component developer composed of a toner and a carrier and a one-component developer composed only of a magnetic or a non-magnetic toner. In general, these toners are manufactured by a melt-kneading pulverization method, where a resin, a pigment, a charge controlling agent and a releasing agent are melt-kneaded, followed by cooling, pulverization and classification, but a particle diameter and a shape of the toner are not uniform, and it is difficult to control them.

Under such circumstances, there is an attempt to intentionally control a particle diameter of toner particles in recent years, trying to solve the aforementioned problems, and toner polymerization methods such as emulsion-polymerization method and dissolution-suspension method became popular as aqueous granulation.

In recent years, due to increased demand for higher quality, especially to achieve a high-definition image in color image formation, there is a growing demand for reduction and homogenization of the toner particle diameter. When an image is formed using a toner having a wide particle-diameter distribution, problems of contamination of a developing roller, a charging roller, a charging blade, a photoconductor, a carrier and so on by fine-powder toner and toner scattering become severe, and it is difficult to fulfill high quality high reliability at the same time. On the other hand, when the particle diameter is uniform and the particle diameter distribution is sharp, developing behavior of individual toner particles becomes uniform, and fine-dot reproducibility significantly improves.

In general, as a fixing system in the electrophotography, a heat-roller heating system that a heat roller is directly pressed on a toner image on a recording medium for fixing is widely used in terms of energy efficiency. The heat-roller heating system requires a large amount of electric power for fixing. Thus, in view of saving energy, reduction of energy consumption of the heat roller has been studied. For example, a system that an output of a heater for a heat roller is reduced when an image is not being output and that a temperature of the heat roller is increased by increasing the output of the heater when an image is being output is generally used.

However, in this case, in order to increase the temperature of the heat roller from a sleep mode to a temperature required for fixing, a standby time of around several tens of seconds is required, and this standby time is stressful for users. Also, when an image is not output, it is desired to suppress energy consumption by completely turning off the heater. To respond to these requests, it is necessary to reduce a fixing temperature of a toner itself and to reduce the fixing temperature of the toner available for fixing.

With the development of electrophotographic technologies, a toner used in the developer is required to have superior low-temperature fixing property, storage stability (blocking resistance) and stress resistance, there have been various attempts to use a polyester resin having high compatibility with a recording medium and so on and superior low-temperature fixing property compared to a styrene resin which has been generally and conventionally used as a binder resin for a toner.

However, a toner designed with an emphasis on low-temperature fixing property has a trade-off relationship with storage stability and stress resistance by softening the resin, and it is required to achieve the both.

In order to solve this problem, a toner having a capsule structure composed of core particles including a resin having a low glass transition temperature, and an outer shell which is formed to coat a surface of the core particles and includes a resin having a high glass transition temperature has been proposed.

For example, a capsule toner is proposed, wherein a mixed solution of a core-material constitutional material including a monomer (polymerizable monomer) as a raw material of a thermoplastic resin and an outer-shell constitutional material including non-crystalline polyester is dispersed in a dispersion medium, and by an in-situ polymerization method, in parallel with a formation of core particles by polymerization, an outer shell is formed by distributing unevenly the outer shell constitutional material on a surface of liquid droplets (see Japanese Patent (JP-B) No. 3030741).

Also, a toner is proposed, wherein an aqueous dispersion liquid of resin particles obtained by emulsion polymerization or soap-free emulsion polymerization is added to polymer particles (core particles) obtained by suspension polymerization so that 95% or more of a surface of the polymer particles is covered by the fine particles, and then it is heated to a temperature of a glass transition temperature of the polymer particles or higher so that the surface has substantially no asperity (see Japanese Patent Application Laid-Open (JP-A) No. 2000-112174).

Also, a toner is proposed, wherein resin particles having at least two different glass transition temperatures and a toner core material (core particles) are mixed, and a coating resin is disposed on the toner core material by fixing or fusing the resin particles while increasing the temperature (see JP-A No. 2001-201891).

Further, a toner obtained by a process including a first step and a second step is proposed, wherein a surface of a core toner (core particles) composed of a binder resin having an average particle diameter of 2 μm to 20 μm and a glass transition temperature of 30° C. to 55° C. is coated with resin particles encapsulating a wax followed by fixing or fusing in the first step and is coated with resin particles which does not include a wax followed by fixing or fusing in the second step (see JP-A No. 2001-235894).

However, in the patent literatures described above, it is possible to improve the problems of storage stability, blocking resistance and aggregation property under a high temperature, but measures for stresses in the developing step have not been taken, degradation of the toner due to developing stresses, and degradation of transfer properly, developing property and cleanability attributed thereto are concerned.

In order to improve transfer property, developing property and cleanability, it is disclosed to combine inorganic fine particles having a medium particle diameter with an average particle diameter of 20 μm to 40 μm as an external additive (see JP-A No. 03-100661).

Also, it is disclosed to use inorganic fine particles having a large particle diameter in order to suppress embedding of an external additive due to stresses in a developing machine (see JP-B No. 3328013, JP-A No. 09-319134, JP-B No. 3056122).

With these, favorable cleanability, transfer property and developing property may be obtained initially, but adhesive strength of the inorganic fine particles vary from particles to particles, and the inorganic fine particles liberate over time, causing contamination in the developing machine or around a photoconductor or resulting in insufficient transfer property and cleanability.

On the other hand, as a means to reduce non-electrostatic adhesion between toner particles and an electrophotographic photoconductor or between toner particles and an intermediate transfer member, a method to adjust a type or an amount of an external additive (especially, adding an external additive having a large particle diameter) is proposed (see JP-A No. 08-176310). With this method, it is possible for the toner particles to improve transfer efficiency with an effect of reduced non-electrostatic adhesion, and at the same time, it is possible to obtain effects such as improved development stability and cleaning.

Further, with reduction of particle diameter of a toner and control of a shape of toner particles in recent years, an added amount of an external additive increases, there are problems of filming, carrier contamination and so on. Also, with toner particles having a shape of a complex structure, it is initially possible to produce a high-quality image, but it becomes difficult to maintain the high-quality image over time due to the external additive embedded or the external additive rolling into concave portions. Especially, in a case where a fine irregular structure on a surface of the toner becomes large, loss of functions increases due to the embedding or rolling of the external additive. Also, when an external additive having a large particle diameter is added, supply property of the toner is affected due to small improvement effect of toner fluidity.

The toner particles described above can initially improve transfer efficiency of an image forming apparatus. However, the toner receives mechanical stresses such as stirring over a long period of time in a developing apparatus of the image forming apparatus, causing the external additive embedded in the toner base or rolling into concave portions of a surface of the toner base. As a result, an effect of reduced adhesion by the external additive is not exhibited, and transfer efficiency of the image forming apparatus decreases. Especially, in a case of a high-speed machine, this mechanical stresses is large due to vigorous stirring in a developing apparatus, and it is likely that embedding of the external additive in the toner base is accelerated. Thus, it is expected that transfer efficiency is reduced at a relatively early stage. In recent years, it is disclosed to suppress embedding by using an external additive having a relatively large particle diameter, but there are problems that an effect of imparting toner fluidity is low as described above and that the free external additive causes filming.

Thus, in order to maintain high transfer efficiency in a high-speed machine in a stable manner over a long period of time, it is necessary to control surface property (mechanical strength) of a toner so that an external additive exists on the surface without being embedded into a toner base despite receiving mechanical stresses. Further, when the surface property (mechanical strength) of the toner is excessively strengthened (hardened), attention should be paid to side effects of degraded fixability, e.g. inhibition of toner melting during fixing or insufficient bleeding of a releasing agent on a fixing roller during fixing in a case of a toner including a releasing agent such as wax and so on. Further, it is possible to maintain high transfer rate by a simple spheronization process of a toner, but it causes a side effect of reduced cleanability of the toner.

Also, for the purpose of improving low-temperature fixing property, a method of introducing crystalline polyester to a polymerization method is disclosed. As a method for preparing a dispersion liquid of crystalline polyester, a method for preparing a dispersion liquid using a solvent for phase separation is disclosed (see JP-B No. 3328013). By using crystalline polyester, it is possible to achieve low-temperature fixing property. However, this is insufficient because an external additive is likely to be embedded with the toner including crystalline polyester, resulting in decrease in transfer efficiency.

Also, use of a non-spherical external additive for improving image density stability is disclosed (see JP-B No. 3684074, JP-A No. 2010-224502). It is possible to achieve improved transfer efficiency by the non-spherical external additive. However, an amount of adhesion of a toner decreases when an aggregate of non-spherical particles are present. Aggressiveness toward a photoconductor increases due to the aggregate of free non-spherical particles, and it causes scratches on the photoconductor. However, such a problem of is not mentioned.

In other words, a spherical toner having a small particle diameter has been developed by aqueous granulation in recent years, but there remains a challenge to cleanability. Surface irregularities increases with toner base particles having a high BET specific surface area, and it is advantageous in cleanability. Also, it reduces an effective coverage of an external additive, and it is effective for low-temperature fixing property. However, for a toner having a high specific surface area relative to toner base, there are many cases where an external additive cannot sufficiently exhibit its effect under stresses due to its irregularities because of the external additive rolling into concave portions or the external additive embedded in convex portions.

SUMMARY OF THE INVENTION

The present invention aims at solving the above problems in the conventional technologies and at achieving the following objection. That is, the present invention aims at providing a toner obtained from toner base particles having a high BET specific surface area, which can exhibit a sufficient effect of an external additive even under stresses, has superior cleanability, improves transfer efficiency, eliminates image defects at each transfer and provides an image having favorable reproducibility over time, and has low-temperature fixing property and high storage stability at a high temperature.

Means for solving the problems are as follows. That is,

A toner for developing an electrostatic image of the present invention is a toner for developing an electrostatic image including:

toner base particles including at least a binder resin and a releasing agent; and inorganic fine particles, wherein the toner includes the inorganic fine particles as an external additive on a surface of the toner base particles, wherein the toner base particles have a BET specific surface area of 2.5 $m^2/g$ to 5.0 $m^2/g$, and wherein the inorganic fine particles include inorganic fine particles (A) which are each a secondary particle where a plurality of primary particles are coalesced together.

The present invention may solve the conventional problems and achieve the objectives above, and it is possible to provide a toner which has superior cleanability, improves transfer efficiency, eliminates image defects at each transfer and provides an image having favorable reproducibility over time, and has low-temperature fixing property and high storage stability at a high temperature.

Figure 1:
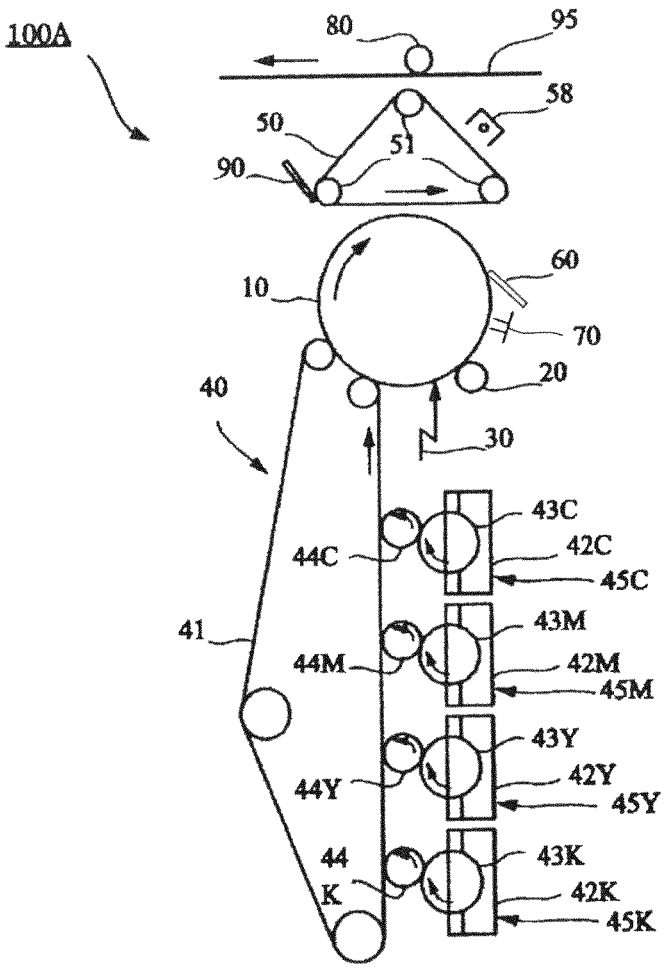
FIG. 1 is a schematic explanatory diagram illustrating one example of an image forming apparatus used in the present invention.

DETAILED DESCRIPTION OF THE INVENTION (Toner for Developing an Electrostatic Image)

A toner for developing an electrostatic image of the present invention (hereinafter, it may be simply referred to as a "toner") is a toner for developing an electrostatic image including: toner base particles including at least a binder resin and a releasing agent; and inorganic fine particles, wherein the toner includes the inorganic fine particles as an external additive on a surface of the toner base particle, the toner base particles have a BET specific surface area of 2.5 $m^2/g$ to 5.0 $m^2/g$, and the inorganic fine particles include inorganic fine particles (A) which are each a secondary particle where a plurality of primary particles are coalesced together.

The toner of the present invention having the above features has suppressed embedding or moving into concave portions of the external additive, which is expected to occur when stresses are applied on the toner such as being stirred in a developing device; thus, it is possible to maintain high transfer rate over time. Further, high cleanability is ensured due to surface irregularities of the toner, and at the same time, effective coverage of the external additive decreases; accordingly, it has a significant effect on low-temperature fixing property.

Usually, when a toner having a small particle diameter is used in an electrophotographic image forming apparatus, non-electrostatic adhesion between toner particles and an electrophotographic photoconductor or between the toner particles and an intermediate transfer member increases, resulting in further decreased transfer efficiency. Especially, when a toner having a small particle diameter is used in a high-speed machine, it has been known that decrease of transfer efficiency during secondary transfer is significant. This is because time for the toner particles subjected to a transfer electric field at a nip portion during transfer, especially at a nip portion during secondary transfer is shortened because of increased processing speed as well as increased non-electrostatic adhesion with an intermediate transfer member due to reduced particle diameter of the toner.

However, it is possible to achieve sufficient transfer efficiency with the toner of the present invention even when non-electrostatic adhesion of toner particles are reduced due to suppressed embedding of the external additive in the toner base and when transfer time is shortened as in a high-speed machine. Also, even when mechanical stresses are large over time as in a high-speed machine, the external additive itself is difficult to roll, and it is unlikely that the external additive falls into the toner concave portions and that the functions of the external additive are lost. Thus, it is possible to maintain sufficient transfer efficiency in the long term. Accordingly, it eliminates the need to reduce the BET specific surface area of the toner base for preventing rolling of the external additive and ensuring fluidity, and at the same time, the BET specific surface area may be increased. As a result, it is possible to reduce the effective coverage of the external additive and to advantage low-temperature fixing property. Further, since an effect equivalent to increased degree of deformation is expected, cleanability over a long period of time may be ensured.

<Production of Toner Base Particles>

The toner base particles include at least a binder resin and a releasing agent, and it further includes other components according to necessity.

According to the present invention, the BET specific surface area of the toner base particles is not particularly restricted as long as it is 2.5 $m^2/g$ to 5.0 $m^2/g$, and it may be appropriately selected according to purpose. Nonetheless, it is preferably 3.0 $m^2/g$ to 4.0 $m^2/g$. When this is less than 2.5 $m^2/g$, it is likely that the external additive is embedded in the base due to the low BET specific surface area. Since high transfer property cannot be maintained or effective coverage of the external additive increases, there is a concern that low-temperature fixing property is inhibited. On the other hand, when it exceeds 5.0 $m^2/g$, degree of deformation is too high, and effective coverage as the external additive is too low. Thus, an adverse effect on storage stability is concerned.

In the preferable toner manufacturing method described hereinafter, for example, the BET specific surface area of the toner base particles may be adjusted by a mixing time or an aging temperature after addition of an aqueous medium in manufacturing the toner base particles. For example, coalescence (convergence) of emulsified particles proceeds by increasing the mixing time after addition of the aqueous medium, resulting in decreased surface irregularities. Also, by increasing the aging temperature, a surface of the binder resin itself is tanned, resulting in the surface smoothed without irregularities.

[Method for Measuring Toner Properties]

<Measurement of Bet Specific Surface Area of Toner Base>

The BET specific surface area of the toner is measured using a Micromeritics Automatic Surface Area and Porosimetry Analyzer TRISTAR 3000 (manufactured by Shimadzu Corporation).

Specifically, 1 g of the toner is placed in a dedicated cell, and the dedicated cell is degassed using a dedicated degassing unit for TRISTAR, VACUPREP 061 (manufactured by Shimadzu Corporation).

The degassing is carried out at a mom temperature and under a reduced pressure of at least 100 mtorr or less for 20 hours.

The BET specific surface area in the dedicated cell after degassing may be automatically measured by TRISTAR 3000.

Here, a nitrogen gas is used as an absorption gas.

<<Binder Resin>>

The binder resin is not particularly restricted, and it may be appropriately selected according to purpose. Heretofore known binder resins such as polyester resins, silicone resin, styrene-acrylic resins, styrene resins, acrylic resins, epoxy resins, diene resins, phenolic resins, terpene resins, coumarin resins, amide-imide resins, butyral resins, urethane resins, ethylene-vinyl acetate resins and so on may be used. These may be used alone or in combination of two or more, and it is preferable to include at least two types of resins.

Among these, the polyester resins are preferable as a resin phase for the toner manufacturing method of the present invention since the resins have sharp-melt property during fixing, smoothen a surface of an image and have sufficient flexibility even when a molecular weight thereof is reduced. It is also possible to use other resins further combined with the polyester resins.

The polyester resins used in the present invention are obtained by polyesterification of one type or two or more types of a polyol represented by General Formula (1) below; and one type or two or more types of a polycarboxylic acid represented by General Formula (2) below.

$$A\text{-}(OH)m \quad (1)$$

[In the formula, A represents an alkyl group, an alkylene group, an aromatic group which may have one or more substituents or a heterocyclic aromatic group, having 1 to 20 carbon atoms; m represents an integer of 2 to 4.]

$$B\text{—}(COOH)n \quad (2)$$

[In the formula, B represents an alkyl group, an alkylene group, an aromatic group which may have one or more substituents or a heterocyclic aromatic group, having 1 to 20 carbon atoms; n represents an integer of 2 to 4.]

Specific examples of the polyol represented by General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexane tetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, bisphenol A ethylene oxide adduct, bisphenol A propylene oxide adduct, hydrogenated bisphenol A, hydrogenated bisphenol A ethylene oxide adduct, hydrogenated bisphenol A propylene oxide adduct and so on.

Specific examples of polycarboxylic acid represented by General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexane tricarboxylic acid, tetra(methylenecarboxyl)methane, 1,2,7,8-octanetetracarboxylic acid, pyromellitic acid, EMPOL trimer acids, cyclohexane dicarboxylic acid, cyclohexanedicarboxylic acid, butanetetracarboxylic acid, diphenylsulfonetetracarboxylic acid, ethylene glycol bis(trimellitic acid) and so on.

—Crystalline Polyester Resin—

As the polyester resin, a crystalline polyester resin may be included.

Favorable examples of the crystalline polyester resin include crystalline polyester synthesized using: as an alcohol component, a saturated aliphatic diol compound having 2 to 12 carbon atoms, especially 1,4-butanediol, 1,6-hexanediol, 1,8-octanediol, 1,10-decanediol, 1,12-dodecanediol and derivatives thereof, and at least as an acid component, dicarboxylic acid having 2 to 12 carbon atoms including a double bond (C═C bond) or a saturated dicarboxylic acid having 2 to 12 carbon atoms, especially fumaric acid, 1,4-butanedioic acid, 1,6-hexanedioic acid, 1,8-octanedioic acid, 1,10-decanedioic acid, 1,12dodecanedioic acid and derivatives thereof.

Among these, it is preferably configured only of one type of the alcohol component selected from 1,4-butanediol, 1,6-hexanediol, 1,8-octanediol, 1,10-decanediol, and 1,12-dodecanediol and one type of a dicarboxylic acid component selected from fumaric acid, 1,4-butanedioic acid, 1,6-hexanedioic acid, 1,8-octanedioic acid, 1,10-decanedioic acid and 1,12-dodecanedioic acid in view of further reducing a temperature difference between an endothermic peak temperature and an endothermic shoulder temperature.

Also, as a method to control crystallinity and softening point of the crystalline polyester resin, for example, non-linear polyester obtained by condensation polymerization with additions of polyhydric alcohol having 3 or more valences such as glycerin and so on to the alcohol component and polycarboxylic acid having 3 or more valences such as trimellitic anhydride as the acid component in synthesizing the polyester is designed and used.

A molecular structure of the crystalline polyester resin of the present invention may be confirmed by solution and solid-state NMR measurements and in addition by x-ray diffraction, GC/MS, LC/MS and IR measurements. Conveniently, it is confirmed, for example, as an absorption based on SCH (out-of-plane bending vibration) of olefins at $965\pm10\ cm^{-1}$ or $990\pm10\ cm^{-1}$ in an infrared absorption spectrum.

—Non-Crystalline Polyester Resin—

In the present invention, a non-crystalline, non-modified polyester resin may be used as the binder resin component. It is preferable that a modified polyester resin obtained by crosslinking and/or elongation reaction of a binder resin precursor composed of a modified polyester resin and the non-modified polyester resin are at least partially dissolved. Thereby, it is possible to improve low-temperature fixing property and hot-offset resistance. Accordingly, the polyols and the polycarboxylic acids of the modified polyester resin and the non-modified polyester resin preferably have similar compositions. Also, as the non-modified polyester resin, it is possible to use the non-crystalline polyester resin used for the crystalline polyester dispersion liquid if it is non-modified.

An acid value of the non-modified polyester resin is usually 1 KOHmg/g to 50 KOHmg/g, and preferably 5 KOHmg/g to 30 KOHmg/g. Thereby, since the acid value is 1 KOHmg/g or greater, the toner is likely to have negative-charging property. Further, affinity between paper and the toner improves during fixing to the paper, and low-temperature fixing property may improve. However, when the acid value exceeds 50 KOHmg/g, charge stability, charge stability against environmental variations in particular, may decrease. In the present invention, the non-modified polyester resin has an acid value of preferably 1 KOHmg/g to 50 KOHmg/g.

The non-modified polyester resin has a hydroxyl value of preferably 5 KOHmg/g or greater. The hydroxyl value is measured using a method based on JIS K0070-1966.

Specifically, first, 0.5 g of a sample is accurately weighed in a 100-mL measuring flask, to which 5 mL of an acetylation reagent is added. Next, after it was heated in a warm bath at 100±5° C. for 1 hour to 2 hours, the flask is taken out from the warm bath and allowed to cool. Further, the flask is shaken with an addition of water to decompose acetic anhydride. Next, for complete decomposition of acetic anhydride, the flask is again heated in a warm bath for 10 minutes or greater and then allowed to cool, and thereafter, a wall of the flask is thoroughly washed with an organic solvent.

Further, using an automatic potentiometric titrator DL-53 TITRATOR (manufactured by Mettler-Toledo International Inc.) and an electrode, DG113-SC (manufactured by Mettler-Toledo International Inc.), the hydroxyl value is measured at 23° C., and it is analyzed using an analysis software LabX Light Version 1.00.000. Here, a mixed solvent of 120 mL of toluene and 30 mL of ethanol is used for calibration of the apparatus.

Here, measurement conditions are as follows.

| Stir | |
|---|---|
| Speed [%] | 25 |
| Time [s] | 15 |
| EQP titration<br>Titrant/Sensor<br>Titrant CH3ONa | |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE(set) [mV] | 8.0 |
| dV(min) [mL] | 0.03 |
| dV(max) [mL] | 0.5 |
| Measure mode | Equilibrium controlled |
| dE [mV] | 0.5 |
| dt [s] | 1.0 |
| t(min) [s] | 2.0 |
| t(max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs<br>n = 1 | Yes |
| comb. termination conditions | No |

-continued

| Evaluation | |
|---|---|
| Procedure | Standard |
| Potential1 | No |
| Potential2 | No |
| Stop for reevaluation | No |

—Modified Polyester Resin—

Examples of the modified polyester resin obtained by crosslinking and/or elongation reaction of a binder resin precursor composed of a modified polyester resin include a urea-modified polyester resin, a urethane-modified polyester resin and so on.

Here, the urea-modified polyester resin may be used in combination with, other than a non-modified polyester resin, a polyester resin modified with a chemical bond other than a urea bond such as polyester resin modified with a urethane bond.

When the toner composition includes a modified polyester resin such as urea-modified polyester resin and so on, the modified polyester resin may be manufactured by a one-shot method and so on.

As one example, a method for producing a urea-modified polyester resin is explained.

First, a polyol and a polycarboxylic acid are heated to 150° C. to 280° C. in the presence of a catalyst such as tetrabutoxy titanate, dibutyltin oxide and so on, and by removing generated water under a reduced pressure according to necessity, a polyester resin having a hydroxyl group is obtained. Next, the polyester resin having a hydroxyl group and a polyisocyanate are reacted at 40° C. to 140° C., and a polyester prepolymer having an isocyanate group is obtained. Further, the polyester prepolymer having an isocyanate group and amines are reacted at 0° C. to 140° C., and the urea-modified polyester resin is obtained.

The urea-modified polyester resin has a number-average molecular weight of usually 1,000 to 10,000, and preferably 1,500 to 6,000.

Here, a solvent may be used according to necessity in a case where a polyester resin containing a hydroxyl group and a polyisocyanate are reacted and a case where polyester prepolymer having an isocyanate group and amines are reacted.

Examples of the solvent include those inert to an isocyanate group such as aromatic solvents (toluene, xylene and so on); ketones (acetone, methyl ethyl ketone, methyl isobutyl ketone and so on); esters (ethyl acetate and so on); amides (dimethylformamide, dimethylacetamide and so on); ethers (tetrahydrofuran and so on) and so on.

Here, when a non-modified polyester resin is used in combination, the resin manufactured in the same manner as the polyester resin having a hydroxyl group may be mixed in the solution after the reaction of the urea-modified polyester resin.

In the present invention, a crystalline the polyester resin, a non-crystalline polyester resin, a binder resin precursor and a non-modified resin may be used in combination as a binder resin component included in an oil phase, and binder resin components other than these resins may further be included. It is preferable to include a polyester resin as the binder resin component, and it is further preferable to include the polyester resin by 50% by mass or greater. When a content of the polyester resin is less than 50% by mass, low-temperature fixing property may degrade. It is particularly preferable that all the binder resin components are polyester resins.

Here, examples of the binder resin components other than the polyester resin include: polymers of styrene or substituted styrene such as polystyrene, poly(p-chlorostyrene), polyvinyltoluene and so on; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, copolymer of styrene-methyl α-chloromethacrylate, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and so on; polymethyl methacrylate, polybutyl methacrylate, polyvinyl chloride, polyvinyl acetate, polyethylene, polypropylene, an epoxy resin, an epoxy polyol resin, a polyurethane resin, a polyamide resin, a polyvinyl butyral, a polyacrylic acid, rosin, modified rosin, a terpene resin, an aliphatic or alicyclic hydrocarbon resin, an aromatic petroleum resin, chlorinated paraffin, paraffin wax and so on.

—Binder Resin Precursor Having a Site Capable of Reacting with a Compound Having an Active Hydrogen Group—

A binder resin precursor having a site capable of reacting with the compound having an active hydrogen group (hereinafter "prepolymer") is not particularly restricted as long as it includes at least a site capable of reacting with a compound having an active hydrogen group, and it may be appropriately selected from heretofore known resins. For example, a polyol resin, a polyacrylic resin, a polyester resin, an epoxy resin, resins of derivatives thereof and so on may be used. Among these, the polyester resin is particularly preferable in view of high fluidity and transparency when melted. Here, these may be used alone or in combination of two or more.

The site capable of reacting with the compound having an active hydrogen group in the prepolymer is not particularly restricted, and it may be appropriately selected from heretofore known substituents and so on. Examples thereof include an isocyanate group, an epoxy group, a carboxylic acid, an acid chloride group and so on. These may be used alone or in combination of two or more. Among these, the isocyanate group is particularly preferable. Among the prepolymers, a polyester resin having a urea bond-forming group (RMPE) is particularly preferable in view of easy control of a molecular weight of a polymeric component, oil-less low-temperature fixing property of a dry toner, and in particular, favorable releasing property and fixability ensured without a releasing oil-coating mechanism against a heating medium for fixing.

Examples of the urea bond-forming group include an isocyanate group and so on. When the urea bond-forming group is the isocyanate group in the polyester resin having a urea bond-forming group (RMPE), an isocyanate group-containing polyester prepolymer (A) is particularly favorable as the polyester resin (RMPE). The isocyanate group-containing polyester prepolymer (A) is not particularly restricted, and it may be appropriately selected according to purpose. Examples thereof include those obtained by a reaction of a polycondensate of a polyol (PO) and a polycarboxylic acid, which is obtained by a reaction of a polyester resin having an active hydrogen group with a polyisocyanate (PIC) and so on. The polyol (PO) is not particularly restricted, and it may be appropriately selected according to purpose. Examples thereof include a diol (DIO), a polyol having 3 or more valences (TO), a mixture of the diol (DIO) and the polyol having 3 or more valences (TO) and so on. These may be used alone or in combination of two or more. Among these, the diol (DIO) alone, and the mixture of the diol (DIO) and a small amount of the polyol having 3 or more valences (TO) are favorable. Examples of the diol (DIO) include alkylene glycols, alkylene ether glycols, alicyclic diols, alkylene oxide adducts of alicyclic diol, bisphenols, alkylene oxide adducts of bisphenol and so on.

As the alkylene glycols, those having 2 to 12 carbon atoms are preferable, and examples thereof include ethylene glycol, 1,2-propylene glycol, 1,3-propylene glycol, 1,4-butanediol, 1,6-hexanediol and so on.

Examples of the alkylene ether glycols include diethylene glycol, triethylene glycol, dipropylene glycol, polyethylene glycol, polypropylene glycol, polytetramethylene ether glycol and so on.

Also, examples of the alicyclic diols include 1,4-cyclohexane dimethanol, hydrogenated bisphenol A and so on. Also, examples of the alkylene oxide adducts of alicyclic diol include adducts of alkylene oxide ethylene oxide, propylene oxide, butylene oxide and so on to an alicyclic diol.

Also, examples of the bisphenols include bisphenol A, bisphenol F, bisphenol S and so on.

Also, examples of the alkylene oxide adducts of bisphenol include adducts of alkylene oxide such as ethylene oxide, propylene oxide, butylene oxide and so on to bisphenols.

Among these, the alkylene glycol having 2 to 12 carbon atoms, alkylene oxide adducts of bisphenol and so on are preferable, and the alkylene oxide adducts of bisphenol and a mixture of the alkylene oxide adduct of bisphenol and the alkylene glycol having 2 to 12 carbon atoms are particularly preferable.

As the polyol having 3 or more valences (TO), those having 3 to 8 valences or greater are preferable, and examples thereof include polyhydric aliphatic alcohols having 3 or more valences, polyphenols having 3 or more valences, alkylene oxide adducts of polyphenols having 3 or more valences and so on.

Also, examples of the polyhydric aliphatic alcohols having 3 or more valences include glycerin, trimethylolethane, trimethylolpropane, pentaerythritol, sorbitol and so on. Also, examples of the polyphenols having 3 or more valences include trisphenols (e.g. TRISPHENOL PA, manufactured by Honshu Chemical Industry Co., Ltd.), phenol novolak, cresol novolak and so on. Also, examples of the alkylene oxide adduct of polyphenols having 3 or more valences include adducts of alkylene oxide such as ethylene oxide, propylene oxide, butylene oxide and so on to the polyphenols having 3 or more valences.

A mixing mass ratio (DIO:TO) of the diol (DIO) and the polyol having 3 or more valences (TO) in the mixture of the diol (DIO) and the polyol having 3 or more valences (TO) is preferably 100:0.01 to 10, and more preferably 100:0.01 to 1.

The polycarboxylic acid (PC) is not particularly restricted, and it may be appropriately selected according to purpose. Nonetheless, examples thereof include a dicarboxylic acid (DIC), a polycarboxylic acid having 3 or more valences (TC), a mixture of the dicarboxylic acid (DIC) and the polycarboxylic acid having 3 or more valences and so on. These may be used alone or in combination of two or more. Among these, the dicarboxylic acid (DIC) alone, or a mixture of the dicarboxylic acid (DIC) and a small amount of the polycarboxylic acid having 3 or more valences (TC) is preferable.

Examples of the dicarboxylic acid (DIC) include alkylene-dicarboxylic acids, alkenylene dicarboxylic acids, aromatic dicarboxylic acids and so on. Also, examples of the alkylene-dicarboxylic acids include succinic acid, adipic acid, sebacic acid and so on. Also, favorable examples of the alkenylene dicarboxylic acids include those having 4 to 20 carbon atoms such as maleic acid, fumaric acid and so on. Also, favorable examples of the aromatic dicarboxylic acids include those having 8 to 20 carbon atoms such as phthalic acid, isophthalic acid, terephthalic acid, naphthalenedicarboxylic acid and so on. Among these, the alkenylene dicarboxylic acids having 4 to 20 carbon atoms and the aromatic dicarboxylic acids having 8 to 20 carbon atoms are preferable.

As the polycarboxylic acids having 3 or more valences (TC), those having 3 to 8 valences or greater are preferable, and examples thereof include aromatic polycarboxylic acids and so on. Also, as the aromatic polycarboxylic acid, those having 9 to 20 carbon atoms are preferable, and examples thereof include trimellitic acid, pyromellitic acid and so on.

As the polycarboxylic acids (PC), it is possible to use acid anhydrides or lower alkyl esters of any one selected from the dicarboxylic acid (DIC), the polycarboxylic acid having 3 or more valences (TC), and a mixture of the dicarboxylic acid (DIC) and the polycarboxylic acid having 3 or more valences. Examples of the lower alkyl esters include methyl esters, ethyl esters, isopropyl esters and so on.

A mixing mass ratio (DIC:TC) of the dicarboxylic acid (DIC) and the polycarboxylic acid having 3 or more valences (TC) in the mixture of the dicarboxylic acid (DIC) and the polycarboxylic acid having 3 or more valences (TC) is not particularly restricted, and it may be appropriately selected according to purpose. For example, it is preferably 100:0.01 to 10, and more preferably 100:0.01 to 1.

A mixing ratio in a polycondensation reaction of the polyol (PO) and the polycarboxylic acid (PC) is not particularly restricted, and it may be appropriately selected according to purpose. For example, an equivalent ratio ([OH]/[COOH]) of a hydroxyl group [OH] in the polyol (PO) and the carboxyl group [COOH] in the polycarboxylic acid (PC) is preferably 2/1 to 1/1, more preferably 1.5/1 to 1/1, and further preferably 1.3/1 to 1.02/1.

A content of the polyol (PO) in the isocyanate group-containing polyester prepolymer (A) is not particularly restricted, and it may be appropriately selected according to purpose. For example, it is preferably 0.5% by mass to 40% by mass, more preferably 1% by mass to 30% by mass, and further preferably 2% by mass to 20% by mass. When the content is less than 0.5% by mass, hot-offset resistance degrades, and it may become difficult to obtain both heat-resistant storage stability and low-temperature fixing property of the toner. When it exceeds 40% by mass, low-temperature fixing property may degrade.

The polyisocyanate (PIC) is not particularly restricted, may be appropriately selected according to purpose. Examples thereof include aliphatic polyisocyanates, alicyclic polyisocyanates, aromatic polyisocyanates, aromatic aliphatic diisocyanates, isocyanurates, and those blocked by phenol derivatives, oximes, caprolactams and so on.

Examples of the aliphatic polyisocyanates include tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, tetramethylhexane diisocyanate and so on. Also, examples of the alicyclic polyisocyanates include isophorone diisocyanate, cyclohexyl diisocyanate and so on. Also, examples of the aromatic polyisocyanate include tolylene diisocyanate, diphenylmethane diisocyanate, 1,5-1,5-naphthylene diisocyanate, diphenylene-4,4'-diisocyanate, 4,4'-diisocyanato-3,3'-dimethyldiphenyl, 3-methyldiphenylmethane-4,4'-diisocyanate, diphenyl ether-4,4'-diisocyanate and so on. Also, examples of the aromatic aliphatic diisocyanates include α,α,α',α'-tetramethylxylylene diisocyanate and so on. Also, examples of the isocyanurates include tris-isocyanatoalkyl-isocyanurate, triisocyanatocycloalkyl-isocyanurate and so on. These may be used alone or in combination of two or more.

As a mixing ratio in reacting the polyisocyanate (PIC) and the polyester resin having an active hydrogen group having an active hydrogen group (e.g. hydroxyl group-containing polyester resin), a mixing equivalent ratio ([NCO]/[OH]) of an isocyanate group [NCO] in the polyisocyanate (PIC) and a hydroxyl group [OH] in the hydroxyl group-containing polyester resin is preferably 5/1 to 1/1, more preferably 4/1 to 1.2/1, and further preferably 3/1 to 1.5/1. When the mixing equivalent ratio ([NCO]/[OH]) exceeds 5, low-temperature fixing property may degrade. When it is less than 1, offset resistance may degrade.

A content of the polyisocyanate (PIC) in the isocyanate group-containing polyester prepolymer (A) is not particularly restricted, and it may be appropriately selected according to purpose. Nonetheless, it is preferably 0.5% by mass to 40% by mass, more preferably 1% by mass to 30% by mass, and further preferably 2% by mass to 20% by mass. When the content is less than 0.5% by mass, hot-offset resistance degrades, and it may become difficult to obtain both heat-resistant storage stability and low-temperature fixing property. When it exceeds 40% by mass, low-temperature fixing property degrades.

An average number of the isocyanate group included in one molecule of the isocyanate group-containing polyester prepolymer (A) is preferably 1 or greater, more preferably 1.2 to 5, and further preferably 1.5 to 4. When the average number of the isocyanate group is less than 1, the polyester resin modified with a urea bond-forming group (RMPE) has a decreased molecular weight, resulting in degraded hot-offset resistance.

A weight-average molecular weight (Mw) of the binder resin precursor having a site capable of reacting with the compound having an active hydrogen group is, as a molecular-weight distribution by GPC (gel permeation chromatography) of a tetrahydrofuran (THF)-soluble content, preferably 3,000 to 40,000, and more preferably 4,000 to 30,000. When the weight-average molecular weight (Mw) is less than 3,000, heat-resistant storage stability may degrade. When it exceeds 40,000, low-temperature fixing property may degrade.

A measurement of the molecular-weight distribution by gel permeation chromatography (GPC) may be carried out as follows, for example. First, a column is stabilized in a heat chamber at 40° C. At this temperature, tetrahydrofuran (THF) as a column medium is flown at a flow rate of 1 mL/min. Then, 50 μL to 200 μL of a tetrahydrofuran sample solution of a resin with the sample concentration adjusted to 0.05% by mass to 0.6% by mass is injected, and measurement is taken. Regarding the measurement of a molecular weight of the sample, a molecular-weight distribution of the sample is calculated from a relation between logarithms of a calibration curve created by several types of monodispersed polystyrene standard samples and the number of count. As the standard polystyrene samples for creating the calibration curve, samples having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$, for example, manufactured by Pressure Chemical Co. or Tosoh Corporation are used, and it is appropriate to use at least 10 standard polystyrene samples. As a detector, an RI (Refractive Index) detector may be used.

<<Releasing Agent>>

The releasing agent is not particularly restricted and may be appropriately selected according to purpose. Nonetheless, a releasing agent having a low melting point that the melting point is 50° C. to 120° C. The releasing agent having a low melting point dispersed with the resin works effectively as a releasing agent between a fixing roller and a toner interface, and thereby hot offset property is favorable even in an oil-less operation (a releasing agent such as oil is not applied on a fixing roller).

As the releasing agent, for example, waxes are favorable. Examples of the waxes include natural waxes including: vegetable waxes such as carnauba wax, cotton wax, japan wax, rice wax and so on; animal waxes such as bees wax, lanolin and so on; mineral waxes such as ozokerite, ceresin and so on; petroleum waxes such as paraffin, microcrystalline wax, petrolatum and so on; and so on. Also, other than these natural waxes, examples further include: synthetic hydrocarbon waxes such as fischer-tropsch wax, polyethylene wax and so on; synthetic waxes such as esters, ketones, ethers and so on; and so on. Further, it is also possible to use: fatty acid amides such as 12-hydroxy stearic amide, stearic amide, phthalic anhydride imide, chlorinated hydrocarbons and so on; homopolymers or copolymers of polyacrylates such as poly-n-stearyl methacrylate, poly-n-lauryl methacrylate and so on as a low-molecular-weight crystalline polymeric resin (for example, a copolymer of n-stearyl acrylate and ethyl methacrylate and so on); and crystalline polymers having a long alkyl group in a side chain thereof. These may be used alone or in combination of two or more.

A melting point of the releasing agent is not particularly restricted, and it may be appropriately selected according to purpose. Nonetheless, it is preferably 50° C. to 120° C., and more preferably 60° C. to 90° C. When the melting point is less than 50° C., the wax may adversely affect heat-resistant storage stability. When it exceeds 120° C., it is likely to cause cold offset during fixing at a low temperature. A melt viscosity of the releasing agent is, as a measured value at a temperature higher by 20° C. than the melting point of the wax, preferably 5 cps to 1,000 cps, and more preferably 10 cps to 100 cps. When the melt viscosity is less than 5 cps, releasing property may degrade. When it exceeds 1,000 cps, effects of improved hot-offset resistance and low-temperature fixing property may not be obtained. A content of the releasing agent in the toner is not particularly restricted, and it may be appropriately selected according to purpose. Nonetheless, it is preferably 0% by mass to 40% by mass, and more preferably 3% by mass to 30% by mass. When the content exceeds 40% by mass, fluidity of the toner may degrade.

<<Other Components>>

The other components are not particularly restricted and may be appropriately selected according to purpose. Examples thereof include a colorant, a charge controlling agent, inorganic fine particles, a fluidity improving agent, a cleanability improving agent, a magnetic material, a metal soap and so on.

<<<Colorant>>>

The colorant for the toner used in the present invention is not particularly restricted, and it may be appropriately selected from heretofore known dyes and pigments according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, quinoline yellow lake, Anthrazane Yellow BGL, isoindolinone yellow, colcothar, red lead, lead vermilion, cadmium red, Cadmium Mercury Red, antimony vermilion, Permanent Red 4R, Para Red, fiser red, para-chloro-ortho-nitroaniline red, Lithol Fast Scarlet G, Brilliant Fast Scarlet, Brilliant Carmine BS, Permanent. Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc, oxide, lithopone and so on. These may be used alone or in combination of two or more.

A content of the colorant in the toner is not particularly restricted, and it may be appropriately selected according to purpose. Nonetheless, it is preferably 1% by mass to 15% by mass, and more preferably 3% by mass to 10% by mass. When the content of the colorant is less than 1% by mass, coloring strength may degrade. When it exceeds 15% by mass, poor dispersion of the pigment in the toner occurs, which may cause decreased coloring strength and decreased electrical characteristics of the toner.

The colorant may also be used as a masterbatch combined with a resin. The resin is not particularly restricted, and it may be appropriately selected from heretofore known ones according to purpose. Examples thereof include polyester, a polymer of styrene or substituent thereof, a styrene copolymer, polymethyl methacrylate, polybutyl methacrylate, polyvinyl chloride, polyvinyl acetate, polyethylene, polypropylene, an epoxy resin, an epoxy polyol resin, polyurethane, polyamide, polyvinyl butyral, polyacrylic acid, rosin, modified rosin, a terpene resin, an aliphatic hydrocarbon resin, an alicyclic hydrocarbon resin, an aromatic petroleum resin, chlorinated paraffin, paraffin wax, and so on. These may be used alone or in combination of two or more.

Examples of the polymer of styrene or substituent thereof include a polyester resin, polystyrene, poly-p-chlorostyrene, polyvinyltoluene, and so on. Examples of the styrene copolymer include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleic acid ester copolymer, and so on.

The masterbatch is manufactured by mixing or kneading the resin for masterbatch and the colorant with an application of high shear force. At this time, to enhance an interaction between the colorant and the resin for masterbatch, an organic solvent is preferably used. Also, a so-called flushing method is favorably used since a wet cake of the colorant may be used as it is, without necessity of drying. This flushing method is a method of mixing or kneading an aqueous paste of the colorant including water with the resin for masterbatch and an organic solvent to remove the water and the organic medium by transferring the colorant to the resin for masterbatch. For the mixing or kneading, for example, a high shear dispersing apparatus such as three-roll mill is favorably used.

<<<Charge Controlling Agent>>

The charge controlling agent is not particularly restricted, and it may be appropriately selected from heretofore known ones according to purpose. Examples thereof include nigrosine dyes, triphenylmethane dyes, chromium-containing metal complex dyes, molybdic acid chelate pigments, rhodamine dyes, alkoxy amines, quaternary ammonium salt (including fluorine-modified quaternary ammonium salts), alkyl amides, elemental phosphorus or phosphorus compound, elemental tungsten or tungsten compounds, fluorine surfactants, metal salts of salicylic acid, metal salts of salicylic acid derivatives, and so on. These may be used alone or in combination of two or more.

Commercial products may be used as the charge controlling agent. Examples of the commercial products include: BONTRON 03 of nigrosine dyes, BONTRON P-51 of quaternary ammonium salt, BONTRON S-34 of metal-containing azo dye, E-82 of oxynaphthoic acid metal complex, E-84 of salicylic acid metal complex, E-89 of phenol condensate (manufactured by Orient Chemical Industries Co., Ltd.); TP-302, TP-415 of quaternary ammonium salt molybdenum complexes (manufactured by Hodogaya Chemical Co., Ltd.); Copy charge PSY VP2038 of quaternary ammonium salt, Copy blue PR of triphenylmethane derivative, Copy charge NEG VP2036, Copy charge NX VP434 of quaternary ammonium salts (manufactured by Clariant (Japan) K.K.); LRA-901, LR-147 as a boron complex (manufactured by Carlit Japan Co., Ltd.); copper phthalocyanine, perylene, quinacridone, azo pigments, other polymeric compounds having functional groups such as sulfonic acid group, carboxyl group, quaternary ammonium salt and so on, and so on.

By incorporating the charge controlling agent selectively in a resin phase of the toner particles main body existing in an inner layer, it is possible to suppress spent charge controlling agent on other members such as photoconductor, carrier and so on. In the toner manufacturing method of the present invention, there are cases where an arrangement of the charge controlling agent is relatively freely designed, and it is possible to take a desired arrangement in accordance with respective image forming processes.

A content of the charge controlling agent in the toner varies depending on the types of the resins, presence or absence of the external additive, dispersion methods and so on, and it cannot be unambiguously defined. Nonetheless, it is preferably 0.1 parts by mass to 10 parts by mass, and more preferably 0.2 parts by mass to 5 parts by mass with respect to 100 parts by mass of the binder resin. When the content of the charge controlling agent is less than 0.1 parts by mass, charge-controlling property may not be obtained. When it exceeds 10 parts by mass, charging property of the toner becomes excessive. This weakens an effect of the main charge controlling agent and increases electrostatically attractive force with a developing roller, which may result in reduced fluidity of a developer and reduced image density.

<<<Fluidity Improving Agent>>>

The fluidity improving agent is defined as an agent for surface treatment to increase hydrophobicity in order to prevent degradation of fluidity properties and charge properties even under high-humidity condition. Examples thereof include a silane coupling agent, a silylating agent, a silane coupling agent having a fluorinated alkyl group, an organic titanate coupling agent, an aluminum-based coupling agent, a silicone oil, a modified silicone oil, and so on. It is particularly preferable to use silica and titanium oxide as hydrophobic silica and hydrophobic titanium oxide by surface treatment thereof with such a fluidity improving agent.

<<<Cleanability Improving Agent>>>

The cleanability improving agent is added to the toner in order to remove a developer which remains on a photoconductor or a primary transfer medium after transfer. Examples thereof include: fatty acid metal salts of stearic acid and so on such as zinc stearate and calcium stearate; polymer particles manufactured by soap-free emulsion polymerization of polymethyl methacrylate fine particles, polystyrene fine particles and so on. The polymer particles preferably have a relatively narrow particle size distribution, and those having a volume-average particle diameter of 0.01 μm to 1 μm are preferable.

<<<Layered Inorganic Mineral>>>

A layered inorganic mineral may be included in the toner according to necessity. The layered inorganic mineral is an inorganic mineral composed of layers with a thickness of several nm, and modification with an organic ion is to introduce an organic ion to ions existing between the layers. It is specifically described in JP-A No. 2003-515795, JP-A No. 2006-500605 and JP-A No. 2006-503313. This is broadly called as intercalation. As the layered inorganic mineral, a smectite group (montmorillonite, saponite and so on), a kaolin group (kaolinite and so on), magadiite, and kanemite are known. The modified layered inorganic mineral is highly hydrophilic due to its modified layered structure. Accordingly, when the layered inorganic mineral is used without modification for a granulated toner produced by dispersion in an aqueous medium, the layered inorganic mineral migrates in the aqueous medium, and it is impossible to deform the toner. However, hydrophilicity increases by modification, and the modified layered inorganic mineral is refined as well as deformed during toner manufacturing. It exists particularly at a surface portion of the toner particles, and it plays a charge-control function and contributes to low-temperature fixing. At this time, a content of the modified layered inorganic mineral in the toner materials is preferably 0.05% by mass to 5% by mass.

The modified layered inorganic mineral used in the present invention is preferably a smectite having a basic crystal structure modified with an organic cation. Also, by substituting a part of a divalent metal of the layered inorganic mineral by a trivalent metal, a metal anion may be introduced. However, since introduction of the metal anion increases hydrophilicity, layered inorganic compound that a part of the metal anion is modified with an organic anion is preferable.

Regarding the layered inorganic mineral including ions at least partially modified with an organic ion, examples of an organic-ion modifying agent of the layered inorganic mineral include quaternary alkylammonium salts, phosphonium salts, imidazolium salts and so on, and the quaternary alkylammonium salts are preferable. Examples of the quaternary alkylammonium include trimethylstearylammonium, dimethylstearylbenzylammonium, dimethylactadecylammonium, oleyl bis(2-hydroxyethyl)methylammonium and so on.

Examples of the organic-ion modifying agent further include sulfates, sulfonates, carboxylates and phosphates inducing branched, non-branched or cyclic alkyl (C1 to C44), alkenyl (C1 to C22), alkoxy (C8 to C32), hydroxyalkyl (C2 to C22), ethylene oxide, propylene oxide and so on. A carboxylic acid having an ethylene oxide skeleton is preferable.

The layered inorganic mineral at least partially modified with an organic ion has moderate hydrophobicity. Thus, the oil phase including the toner composition and/or the toner composition precursor has a non-Newtonian viscosity, and the toner may be deformed. At this time, a content of the layered inorganic mineral partially modified with an organic ion in the toner materials is preferably 0.05% by mass to 5% by mass.

The layered inorganic mineral partially modified with an organic ion may be appropriately selected, and examples thereof include montmorillonite, bentonite, hectorite, attapulgite, sepiolite, mixtures thereof and so on. Among these, organically modified montmorillonite or bentonite is preferable since it allows easier viscosity control only with a small amount without affecting toner properties.

Examples of commercial products of the layered inorganic mineral partially modified with an organic cation include: quaternium-18 bentonite such as Benton 3, Bentone 38, Benton 38V (manufactured by Rheox Corporation), TIXOGEL VP (manufactured by United Catalyst), CLAYTON 34, CLAYTON 40, CLAYTON XL (manufactured by Southern Clay Products, Inc.) and so on; stearalkonium bentonite such as Bentone 27 (manufactured by Rheox Corporation), TIXOGEL LG (manufactured by United Catalyst), CLAYTON AF, CLAYTON APA (manufactured by Southern Clay Products, Inc.) and so on; quaternium-18/benzalkonium bentonite such as CLAYTON HT, CLAYTON PS (manufactured by Southern Clay Products, Inc.) and so on. CLAYTON AF and CLAYTON APA are particularly preferable. Also, as a layered inorganic mineral partially modified with an organic anion, DHT-4A (manufactured by Kyowa Chemical Industry Co., Ltd.) modified with an organic anion represented by General Formula (3) below is particularly preferable. Exemplary compounds of General Formula (3) include HITENOL 330T (manufactured by Dai-ichi Kogyo Seiyaku Co., Ltd.).

$$R_1(OR_2)nOSO_3M \qquad \text{General Formula (3)}$$

[In the formula, $R_1$ represents an alkyl group having 13 carbon atoms; $R_2$ represents an alkylene group having 2 to 6 carbon atoms; n represents an integer of 2 to 10; M represents a monovalent metal element.]

The modified layered inorganic mineral provides appropriate hydrophobicity. In a manufacturing process of the toner including this, the oil phase including the toner composition has a non-Newtonian viscosity, and the toner may be deformed.

<Inorganic Fine Particles>

The inorganic fine particles includes at least inorganic fine particles (A) which are each a secondary particle where a plurality of primary particles are coalesced together, and it further includes other inorganic fine particles according to necessity.

The inorganic fine particles are used as an external additive for imparting fluidity, developing property, charging property and so on to the toner particles. It is important that these inorganic fine particles include the inorganic fine particles (A) which are each a secondary particle where a plurality of primary particles are coalesced together.

<<Inorganic Fine Particles (A)>>

The primary particles of the inorganic fine particles (A) are not particularly restricted, and they may be appropriately selected from heretofore known ones according to purpose. Examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride and so on. These may be used alone or in combination of two or more. Among these, silica is preferable.

As the inorganic fine particles (A), coalesced silica is preferable.

The coalesced silica is secondary aggregated silica obtained by chemically bonding primary particles of silica and/or fused silica using a treating agent.

The coalesced silica used in the present invention is prepared by chemically bonding primary particles of crystalline silica and/or fused silica using a treating agent, and as the treating agent, a silane-based agent such as alkoxysilanes, silane coupling agents, chlorosilanes, silazanes and so on or an epoxy-based treating agent such as liquid epoxy resin are favorably used.

When primary silica particles are processed using the silane-based agent such as alkoxysilanes, silane coupling agent and so on, a silanol group bonded to the primary silica particles and an alkoxy group bonded to the silane-based agent react, and a Si—O—Si bond is newly formed by dealcoholization.

That is, the primary silica particles form secondary aggregation by chemical bonding via the silane-based agent as indicated in the formula below.

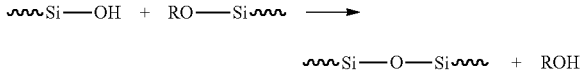

When the primary silica particles are processed using the chlorosilanes, a chloro group of the chlorosilanes and a silanol group bonded to the primary silica particles newly forms a Si—O—Si bond by a dehydrochlorination reaction. Also, in case water co-exists in the system, the chlorosilanes is hydrolyzed in water to form a silanol group and then the silanol group and a silanol group bonded to the primary silica particles newly forms a Si—O—Si bond by a dehydration reaction. Thereafter, secondary aggregation occurs.

Also, as for the silazanes, an amino group and a silanol group bonded to the primary silica particles undergo deammoniation to newly form a Si—O—Si bond, followed by secondary aggregation.

Meanwhile, when the primary silica particles is processed using the epoxy-based treating agent, a silanol group bonded to the primary silica particles adds an oxygen atom of the epoxy group and a carbon atom bonded to the epoxy group of the epoxy-based treating agent and newly forms a Si—O—C bond.

That is, the primary silica particles form secondary aggregation by chemical bonding via the epoxy-based treating agent as indicated in the formula below.

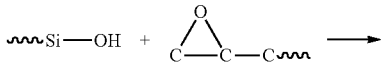

-continued

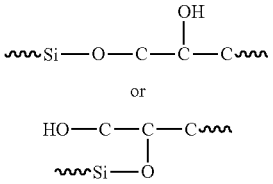

The coalesced silica used in the present invention is produced by preparation of silica as primary particles followed by a process using the silane-based agent or the epoxy-based treating agent, and it may be used as a filler of an epoxy resin. Also, when silica is synthesized by a sol-gel method, the coalesced silica may be prepared in a one-step reaction by allowing the silane-based agent or the epoxy-based treating agent to co-exist.

Also, regarding use as the treating agent, since the generated Si—O—Si bond is more stable against heat than the Si—O—C bond, the silane-based agent is more preferable than the epoxy-based treating agent. Specific examples of the alkoxysilanes as the silane-based agent include tetramethoxysilane, tetraethoxysilane, methyltrimethoxysilane, methyltriethoxysilane, dimethyldimethoxysilane, dimethyldiethoxysilane, methyldimethoxysilane, methyldiethoxysilane, diphenyldimethoxysilane, isobutyltrimethoxysilane, decyltrimethoxysilane and so on.

Also, specific examples of the silane coupling agent as the above silane-based agent include γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane, methylvinyldimethoxysilane and so on.

Further, specific examples of the silane-based agent other than the alkoxysilanes or the silane coupling agent include vinyltrichlorosilane, dimethyldichlorosilane, methylvinyldichlorosilane, methyl phenyl dichlorosilane, phenyltrichlorosilane, N,N'-bis(trimethylsilyl)urea, N,O-bis(trimethylsilyl)acetamide, dimethyl trimethylsilyl amine, hexamethyldisilazane, cyclicsilazane mixture and so on.

Specific examples of the epoxy-based treating agent include a bisphenol A epoxy resin, a bisphenol F epoxy resin, a phenol novolak epoxy resin, a cresol novolak epoxy resin, a bisphenol A novolak epoxy resin, a biphenol epoxy resin, a glycidyl amine epoxy resin, an alicyclic epoxy resin and so on.

The coalesced silica used in the present invention is prepared by chemically bonding primary particles of the crystalline silica and/or the fused silica using the treating agent, and as the process, the primary silica particles and the treating agent are mixed using a heretofore known mixer such as spray dryer and so on at a mass ratio of 100:0.01 to 100:50.

At this time, as a processing aid, for example, water, a 1-% acetic acid aqueous solution and so on may be appropriately added.

A mixture of the primary silica particles and the treating agent is then baked, and a baking temperature thereof is selected from a temperature range of 100° C. to 2500° C.

Also, a baking time is 0.5 hours to 30 hours.

A degree of coalescence of silica may be arbitrarily controlled by varying primary particle diameter, types and amounts of the treating agent, and processing conditions.

That is, an aggregation force is stronger by using the silane-based agent rather than the epoxy-based treating agent, by increasing an amount of the treating agent with respect to the primary silica particles, or by increasing the baking temperature, respectively, and the degree of coalescence tends to be higher. On the other hand, by increasing the baking time, a proportion of non-coalesced particles may be reduced. However, excessive extension of time promotes aggregation between coalesced particles, and there is a possibility of a problem on an adhesive property to the toner.

An amount of the inorganic fine particles (A) added with respect to 100 parts by mass of the toner is preferably 1.0 part by mass to 3.0 parts by mass, and more preferably 1.5 parts by mass to 2.5 parts by mass. When it is less than 1.0 parts by mass, a sufficient spacer effect cannot be obtained, and it is difficult to suppress embedding by external stresses. On the other hand, when it exceeds 3.0 parts by mass, there is a concern that an amount of withdrawal increases, causing defects such as photoconductor filming and phenomenon of vibrating cleaning blade (a so-called chatter vibration) and so on.

Also, the inorganic fine particles (A) have $Db_{50}/Db_{10}$ in a particle size distribution of a secondary particle diameter Db of preferably 1.20 or less, and more preferably 1.15 or less. Here, $Db_{50}$ represents a particle diameter at which a cumulative percentage of the secondary particle diameter measured from a side of smaller particles and observed by an FE-SEM is 50% by number, and $Db_{10}$ represents a particle diameter at which the cumulative percentage measured from the side of smaller particles is 10% by number.

$Db_{50}/Db_{10}$ represents a proportion of particles having a smaller secondary particle diameter and median particles. A large value thereof indicates there are many particles having a smaller secondary particle diameter. That is, it means that there are many particles A existing as primary particles with coalescence not progressed, or there are many particles B with coalescence progressed but composed of primary particles themselves having a small particle diameter, or both thereof. Such particles A or B respectively do not have sufficient features. The particles A cannot completely fulfill a function as the deformed external additive and is inferior in terms of resistance to embedding, and thus there is a concern of occurrences of an abnormal image. On the other hand, the particles B cannot completely fulfill a function of the spacer effect, and it is unlikely to suppress embedding by external stresses. It is preferable to reduce these particles, or in other words, to have a large value of $Db_{10}$. When $Db_{50}/Db_{10}$ exceeds 1.2, the particles A and B are in abundance, and it becomes difficult to fulfill the function as the deformed external additive characterized for suppression of embedding.

Also, when a ratio (Db/Da) with Db being the secondary particle diameter of the inorganic fine particles (A) and Da being an average primary particle diameter of a plurality of primary particles forming the inorganic fine particles (A) is defined as the degree of coalescence of the inorganic fine particles (A), an average of the degrees of coalescence G is not particularly restricted and may be appropriately selected according to purpose. Nonetheless, it is preferably in a range of 1.5 to 4.0, and more preferably 2.0 to 3.0.

When the degree of coalescence G is less than 1.5, a function to maintain high transfer property is slightly inferior. This is because the external additive is likely to be embedded in the base and the external additive is likely to roll into concave portions. Also, the toner with the degree of coalescence exceeding 4.0 is slightly weak in terms of degradation over time. This is because the external additive is likely to be exfoliated from the toner, causing carrier contamination or scratches on a photoconductor.

Also, a content of inorganic fine particles (A) with the degree of coalescence G of less than 1.3 in the inorganic fine particles (A) is not particularly restricted, and it may be appropriately selected according to purpose. Nonetheless, it is preferably 10% by number or less.

The degree of coalescence G has a distribution due to its manufacturing nature. Particles having the degree of coalescence of less than 1.3 are particles with coalescence not progressed, existing in an almost spherical state. Accordingly, it is difficult to fulfill the function as the deformed external additive characterized for suppressing embedding.

Also, an average secondary particle diameter of the coalesced silica Dba is not particularly restricted, and it may be appropriately selected according to purpose. Nonetheless, it is preferably 80 nm to 200 nm, and more preferably 100 nm to 160 nm. When it is less than 80 nm, the silica becomes difficult to fulfill the function as the spacer effect and difficult to suppress embedding by external stresses. On the other hand, when it exceeds 200 nm, the silica is easily freed from the toner, causing photoconductor filming.

[Method for Measuring Properties of Inorganic Fine Particles]

<Measurement of Degree of Coalescence>

Figure 5:
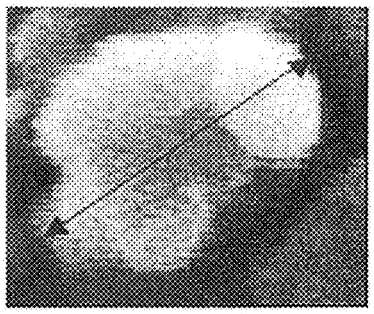
FIG. 5 is an FE-SEM image of inorganic particles (A) as an external additive of a toner of the present invention, with an arrow indicating a secondary particle diameter.

The degree of coalescence is measured by an image observation. The inorganic fine particles (A) are dispersed in an appropriate solvent (THF and so on), and then the sample on a substrate with the solvent removed to dryness is observed by FE-SEM. With an accelerating voltage of 5 kV to 8 kV and an observation magnification of 8 k to 10 k, the secondary particle diameter of the inorganic fine particles (A) in a field of view is measured. As the secondary particle diameter, a maximum length of aggregated particles is measured. FIG. 5 illustrates one example.

Figure 6:
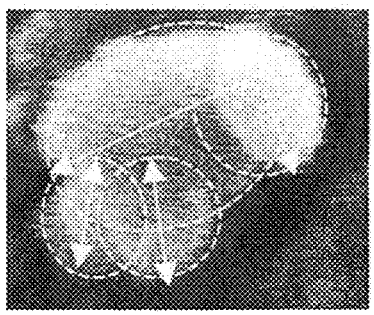
FIG. 6 is an FE-SEM image of inorganic particles (A) as an external additive of a toner of the present invention, with an arrow indicating a primary particle diameter.

The primary particle diameter is similarly observed by FE-SEM. An overall image of embedded particles is predicted from an outline of the coalesced inorganic fine particles (A), and a maximum length of the overall image is measured. FIG. 6 illustrates one example. The secondary particle diameter of one inorganic fine particle (A) and an average of the primary particle diameter of a plurality of primary particles coalesced in the inorganic fine particles are obtained, and the degree of coalescence is determined.

$$\text{Degree of coalescence} = \text{secondary particle diameter} / \text{average primary particle diameter}$$

Observations are made for 100 or more inorganic fine particles (A) to obtain the degree of coalescence of the respective particles, and an average of the degree of coalescence and a ratio of the inorganic fine particles (A) having a degree of coalescence of less than 1.3 are obtained.

By the above measurement method, the particle size distribution of the secondary particle diameter is obtained, and further $Db_{50}$ and $Db_{10}$ are calculated.

<<Other Inorganic Fine Particles>>

Other inorganic fine particles may be used in combination in the toner of the present invention for assisting fluidity, developing property and charging property.

The inorganic fine particles used in combination has a primary particle diameter of preferably 5 nm to 70 nm, and more preferably 5 nm to 50 nm. A proportion of these inorganic fine particles is preferably 0.01% by mass to 5% by mass, and more preferably 0.01% by mass to 2.0% by mass of the toner.

Examples of the other inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride and so on.

[Method for Manufacturing Toner]

A toner manufacturing method of the present invention is not particularly restricted, may be appropriately selected according to purpose. Examples thereof include a pulverization method, polymerization methods such as emulsion-aggregation method and dissolution-suspension method and so on. The dissolution-suspension method is preferably used in order to obtain a toner having a small particle diameter and a small Dv/Dn.

The toner of the present invention is preferably a toner obtained by granulation in an aqueous medium. A toner produced by obtaining an emulsified dispersion by dispersing in an aqueous medium an oil phase obtained by dissolving or dispersing toner materials including at least a polyester resin, a colorant and a releasing agent in an organic solvent and by removing the organic solvent from the emulsified dispersion. A particularly favorable toner is produced by obtaining an emulsified dispersion by dispersing in an aqueous medium an oil phase obtained by dissolving or dispersing toner materials including at least a compound having an active hydrogen group, the binder resin precursor having a site capable of reacting with a compound having an active hydrogen group, a polyester resin, a colorant and a releasing agent, by reacting the binder resin precursor and the compound having an active hydrogen group in the emulsified dispersion and by removing the organic solvent.

As the respective manufacturing methods, a toner is manufactured specifically as follows.

The pulverization method is a method to obtain base particles of the toner by, for example, melting or kneading toner materials followed by pulverization, classification and so on.

Here, in the pulverization method, a mechanical impact may be applied to control a shape of the obtained toner base particles obtained for the purpose that the toner has an average circularity in a range of 0.97 to 1.0.

In this case, the mechanical impact may be applied to the toner base particles using devices such as hybridizer, mechanofusion and so on.

An aqueous granulated toner may be manufactured by the emulsion-aggregation method or the dissolution-suspension method as follows.

<Emulsion-Aggregation Method>

There is an emulsion-polymerization-aggregation method as a method to produce a toner by dispersing and/or emulsifying an oil phase or a monomer phase including at least a toner composition or a toner composition precursor in an aqueous medium for granulation.

In the emulsion-polymerization-aggregation-fusion method includes: a step for preparing an aggregated-particle dispersion liquid by mixing a resin-particle dispersion liquid prepared by an emulsion polymerization method, a separately prepared layered inorganic mineral at least partially modified with an organic ion, a colorant dispersion liquid, and a releasing-agent dispersion liquid according to necessity for aggregating at least the resin particles, the layered inorganic mineral at least partially modified with an organic ion and the colorant to form aggregated particles (hereinafter, it may also be referred to as an "aggregation step"); and a step for forming toner particles by heating and fusing the aggregated particles (hereinafter, it may also be referred to as a "fusing step").

In the aggregation step, the resin-particle dispersion liquid, the layered inorganic mineral at least partially modified with an organic ion, the colorant dispersion liquid and the releasing-agent dispersion liquid according to necessity are mixed with one another, and by aggregating the resin particles and so on to form the aggregated particles. The aggregated particles are formed by heteroaggregation and so on, and at that time, it is possible to add an ionic surfactant having a different polarity from the aggregated particles or a compound having a charge of one or more valences such as such as metal salts for the purpose of stabilization and control of the particle diameter/particle size distribution of the aggregated particles. In the fusing step, the aggregated particles are heated to a temperature of the glass transition temperature of resins in the aggregated particles or greater for fusion.

Before the fusing step, it is possible to arrange an adhesion step, wherein a dispersion liquid of other fine particles is added and mixed to the aggregated-particle dispersion liquid for uniformly adhering fine particles on a surface of the aggregated particles to form adhered particles. Further, it is possible to arrange an adhesion step, wherein a dispersion liquid of the layered inorganic mineral at least partially modified with an organic ion is added and mixed in the aggregated-particle dispersion liquid for uniformly adhering the layered inorganic mineral at least partially modified with an organic ion on a surface of the aggregated particles to form adhered particles. Also, in order to strengthen the adhesion of the layered inorganic mineral at least partially modified with an organic ion, it is possible to arrange an adhesion step after adhering the layered inorganic mineral at least partially modified with an organic ion, wherein a dispersion liquid of other fine particles is added and mixed for uniformly adhering fine particles on a surface of the aggregated particles to form adhered particles. These adhered particles are formed by heteroaggregation and so on. This adhered-particle dispersion liquid may be heated to a temperature of the glass transition temperature of the resin particles in the similar manner for fusion to form fused particles.

The fused particles fused in the fusing step exist as a colored-and-fused-particle dispersion liquid in the aqueous medium. In a washing step, the fused particles are taken out from the aqueous medium, and at the same time, impurities and so on mixed in the above steps are removed. They are then dried, and a toner for developing an electrostatic image as a powder is obtained.

In the washing step, acidic water, or basic water in some cases, is added to the fused particles several times in an amount followed by stirring and filtering to obtain a solid content. Pure water is added to this solid content several times in an amount followed by stirring and filtering. This operation is repeated several times until a filtrate after filtration has a pH of about 7, and colored toner particles are obtained. In the drying step, the toner particles obtained in the washing step is dried at a temperature of less than the glass transition temperature. At this time, methods such as circulating dry air and heating under vacuum conditions are taken according to necessity.

A small amount of surfactants may be used in case of the resin-particle dispersion liquid not necessarily stable under basic conditions because of stability of pH and so on of the colorant dispersion liquid or the releasing-agent dispersion liquid or for the purpose of obtaining stability over time of the resin-particle dispersion liquid.

Examples of the surfactants include: anionic surfactants of sulfates, sulfonates, phosphate esters, soaps and so on; cationic surfactants of amine salts, quaternary ammonium salts and so on; and non-ionic surfactants of polyethylene glycol, alkylphenol ethylene oxide adducts, polyhydric alcohols and so on. Among these, ionic surfactants are preferable, and the anionic surfactants and cationic surfactants are more preferable. In the toner of the present invention, the anionic surfactants generally have high dispersion power and are superior in dispersibility of the resin particles and the colorants, and thus the cationic surfactant are advantageous as a surfactant for dispersing the releasing agent. The non-ionic surfactant is preferably used in combination with the anionic surfactants or the cationic surfactants. These surfactants may be used alone or in combination of two or more.

Specific examples of the anionic surfactant include: fatty acid soaps such as potassium laurate, sodium oleate, sodium castor oil and so on; sulfuric acid esters such as octyl sulfate, lauryl sulfate, lauryl ether sulfate, nonyl phenyl ether sulfate and so on; lauryl sulfonate, dodecylbenzene sulfonate; sodium alkylnaphthalene sulfonate, naphthalene sulfonate formalin condensate such as trisopropylnaphthalene sulfonate, dibutylnaphthalene sulfonate and so on; sulfonic acid salts such as monooctyl sulfosuccinate, dioctyl sulfosuccinate, amidosulfonate laurate, amidosulfonate oleate and so on; phosphoric acid esters such as lauryl phosphate, isopropyl phosphate, nonyl phenyl ether phosphate and so on; dialkylsulfosuccinate salts such as sodium dioctylsulfosuccinate and so on; sulfosuccinate salts such as disodium lauryl sulfosuccinate and so on; and so on.

Specific examples of the cationic surfactant include: amine salts such as laurylamine hydrochloride, stearylamine hydrochloride, oleylamine acetate, stearylamine acetate, stearylaminopropylamine acetate and so on; quaternary ammonium salts such as lauryltrimethylammonium chloride, dilauryldimethylammonium chloride, distearylammonium chloride, distearyldimethylammonium chloride, lauryldihydroxyethylmethylammonium chloride, oleyl-bis-polyoxyethylenemethylammonium chloride, lauroylaminopropyldimethylethylammonium ethosulfate, lauroylaminopropyldimethylhydroxyethylammonium perchlorate, alkylbenzenedimethylammonium chloride, alkyltrimethylammonium chloride and so on.

Specific examples of the non-ionic surfactant include: alkyl ethers such as polyoxyethylene octyl ether, polyoxyethylene lauryl ether, polyoxyethylene stearyl ether, polyoxyethylene oleyl ether; alkylphenyl ethers such as polyoxyethylene octylphenyl ether, polyoxyethylene nonylphenyl ether and so on; alkyl esters such as polyoxyethylene laurate, polyoxyethylene stearate, polyoxyethylene oleate and so on; alkylamines such as polyoxyethylene laurylamine ether, polyoxyethylene stearylamino ether, polyoxyethylene oleylamino ether, polyoxyethylene soybean amino ether, polyoxyethylene beef tallow amino ether and so on; alkyl amides such as polyoxyethylene lauric amide, polyoxyethylene stearic amide, polyoxyethylene oleic amide and so on; vegetable oil ethers such as polyoxyethylene castor oil ether, polyoxyethylene canola ether and so on; alkanolamides such as lauric acid diethanolamide, stearic acid diethanolamide, oleic acid diethanolamide and so on; sorbitan ester ethers such as polyoxyethylene sorbitan monolaurate, polyoxyethylene sorbitan monopalmitate, polyoxyethylene sorbitan monostearate, polyoxyethylene sorbitan monooleate and so on.

A content of the surfactant in each dispersion liquid may be about an amount that does not inhibit the characteristics of the present invention, and it is generally a small amount. Specifically, for the resin-particle dispersion liquid, it is around 0.01% by mass to 1% by mass, preferably 0.02% by mass to 0.5% by mass, and more preferably 0.1% by mass to 0.2% by mass. When the content is less than 0.01% by mass, a pH of the resin-particle dispersion liquid in particular is not in a not sufficiently basic condition, which may cause aggregation. For the colorant dispersion liquid and the releasing agent dispersion liquid, the content is 0.01% by mass to 10% by mass, preferably 0.1% by mass to 5% by mass, and more preferably 0.5% by mass to 0.2% by mass. The content of less than 0.01% by mass is not preferable because of occurrence of liberation of specific particles due to different stability among particles during aggregation. Also, the content exceeding 10% by mass is not preferable because there are problems of widened particle size distribution of particles or difficulty in controlling the particle diameter.

The toner of the present invention may include, other than the resin, the colorant and the releasing agent, fine particles of other components such as internal additive, charge controlling agent, inorganic granular material, organic granular material, lubricant, polishing agent and so on may be added according to purpose.

The internal additive is used to an extent that does not inhibit charging property as the toner characteristics. For example, magnetic bodies of metals such as ferrite, magnetite, reduced iron, cobalt, manganese, nickel and so on, alloys, or compounds including these metals are used.

As described above, when the resin-particle dispersion liquid, a dispersion liquid of the layered inorganic mineral at least partially modified with an organic ion, the colorant dispersion liquid and the releasing-agent dispersion liquid are mixed, a content of the colorant is 50% by mass or less, and it is preferably 2% by mass to 40% by mass. A content of the layered inorganic mineral at least partially modified with an organic ion is preferably 0.05% by mass to 10% by mass. Also, a content of the other components is an amount that does not inhibit the purpose of the present invention. It is generally very small, and it is specifically 0.01% by mass to 5% by mass, and preferably 0.5% by mass to 2% by mass.

In the present invention, as a dispersion medium of the resin-particle dispersion liquid, the dispersion liquid of the layered inorganic mineral at least partially modified with an organic ion, the colorant dispersion liquid, the releasing-agent dispersion liquid and the dispersion liquid of other components, aqueous medium is used, for example. Examples of the aqueous medium include water such as distilled water, ion-exchanged water and so on, alcohols and so on. These may be used alone or in combination of two or more.

In a step for preparing the aggregated-particle dispersion liquid of the present invention, aggregation is caused by adjusting an emulsifying power of the emulsifier with its pH, and thereby aggregated particles are prepared. At the same time, in order to achieve stable and speedy aggregation of the particles and to obtain the aggregated particles having a narrower particle size distribution, an aggregating agent may be added. As the aggregating agent, a compound having a charge or one or more valences is preferable, and specific examples thereof include: water-soluble surfactants such as ionic surfactant, nonionic surfactant above and so on; acids such as hydrochloric acid, sulfuric acid, nitric acid, acetic acid, oxalic acid and so on; metal salts of inorganic acids such as magnesium chloride, sodium chloride, aluminum sulfate, calcium sulfate, ammonium sulfate, aluminum nitrate, silver nitrate, copper sulfate, sodium carbonate and so on; metal salts of aliphatic acids or aromatic acids such as sodium acetate, potassium formate, sodium oxalate, sodium phthalate, potassium salicylate and so on; metal salts of phenols such as sodium phenolate and so on; inorganic acid salts of aliphatic or aromatic amines such as metal salts of amino acids, triethanolamine hydrochloride, aniline hydrochloride and so on. The metal salts of inorganic acids are preferable in terms of performance and usage when stability of the aggregated particles, stability of the aggregating agent against heat and time, and removal of the aggregating agent during washing are considered.

An added amount of these aggregating agents varies depending on the number of valences of the charge, but it is nonetheless small. It is around 3% by mass or less for a monovalent agent, it is around 1% by mass or less for a divalent agent, and it is around 0.5% by mass or less for a trivalent agent. The added amount of the aggregating agent is preferably small, and compounds having larger valences are preferable since it may reduce the added amount.

<Dissolution-Suspension Method>

In a toner manufacturing method of the present invention, a binder resin or a toner material having binder resin materials and a colorant as main components is dissolved or dispersed in an organic solvent, thus formed solution or dispersion liquid is emulsified or dispersed in an aqueous medium to prepare an emulsified liquid or a dispersion liquid, and a desired toner is manufactured. Preferably, a solution or a dispersion liquid of toner materials including at least a compound having an active hydrogen group and a binder resin precursor having a site capable of reacting with the compound having an active hydrogen group is emulsified or dispersed in an aqueous medium, the compound having an active hydrogen group and the binder resin precursor having a site capable of reacting with the compound having an active hydrogen group are reacted in the aqueous medium to form toner base particles including at least an adhesive base, and thereby a desired toner is manufactured.

—Solution or Dispersion Liquid of Toner Materials—

The solution or dispersion liquid of toner materials is prepared by dissolving or dispersing toner materials in a solvent. The toner materials are not particularly restricted as long as it is able to form a toner, and it may be appropriately selected according to purpose. For example, it includes either the compound having an active hydrogen group or the binder resin precursor having a site capable of reacting with the compound having an active hydrogen group (prepolymer), and it may further include the other components such as non-modified polyester resin, releasing agent, colorant, charge controlling agent and so on according to necessity. The solution or dispersion liquid of toner materials is preferably prepared by dissolving or dispersing the toner materials in an organic solvent. Here, the organic solvent is preferably removed after during granulation or after granulation of the toner.

—Organic Solvent—

The organic solvent for dissolving or dispersing the toner materials is not particularly restricted as long as it is a solvent which may dissolve or disperse the toner materials, and it may be appropriately selected according to purpose. Nonetheless, those having a boiling point of less than 150° C. are preferable in view of easy removal during granulation or after granulation of the toner. Examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, methyl isobutyl ketone and so on. Also, an ester-based solvent is preferable, and ethyl acetate is particularly preferable. These may be used alone or in combination of two or more. An amount of the organic solvent used is not particularly restricted, and it may be appropriately selected according to purpose. Nonetheless, it is preferably 40 parts by mass to 300 parts by mass, more preferably 60 parts by mass to 140 parts by mass, and further preferably 80 parts by mass to 120 parts by mass with respect to 100 parts by mass of the toner materials. Here, the solution or dispersion liquid of the toner materials is prepared by dissolving or dispersing the toner materials such as compound having an active hydrogen group, binder resin precursor having a site capable of reacting with a compound having an active hydrogen group, non-modified polyester resin, releasing agent, colorant, charge controlling agent, and so on in the organic solvent. Also, among the toner materials, components other than the binder resin precursor having a site capable of reacting with the compound having an active hydrogen group (prepolymer) may be added and mixed in the aqueous medium in a preparation of the aqueous medium described hereinafter or may be added to the aqueous medium along with the solution or dispersion liquid when the solution or dispersion liquid of toner materials is added to the aqueous medium.

—Aqueous Medium—

The aqueous medium is not particularly restricted, and it may be appropriately selected from heretofore known ones. For example, water, a solvent miscible with water, a mixture thereof and so on may be used. Among these, water is particularly preferable. A solvent miscible with water is not particularly restricted as long as it is miscible with water. Examples thereof include alcohols, dimethylformamide, tetrahydrofuran, cellosolves, lower ketones and so on. Examples of the alcohols include methanol, isopropanol, ethylene glycol and so on. Also, examples of the lower ketones include acetone, methyl ethyl ketone and so on. These may be used alone or in combination of two or more.

<<Emulsification or Dispersion>>

Emulsification or dispersion of the solution or the dispersion liquid of the toner materials in the aqueous medium is preferably carried out by dispersing the solution or the dispersion liquid of the toner materials in the aqueous medium with stirring. A dispersing method is not particularly restricted, and it may be appropriately selected according to purpose. For example, it may be carried out using heretofore known dispersion equipment. Examples of the dispersion equipment include a low-speed shearing equipment, a high-speed shearing equipment and so on. In this toner manufacturing method, in the emulsification or dispersion, by subjecting the compound having an active hydrogen group and the binder resin precursor having a site capable of reacting with the compound having an active hydrogen group to an elongation reaction or crosslinking reaction, the adhesive base is formed.

—Adhesive Base—

The adhesive base exhibits adhesive property to recording media such as paper, and it preferably includes an adhesive polymer formed by reacting the compound having an active hydrogen group and the binder resin precursor having a site capable of reacting with the compound having an active hydrogen group in an aqueous medium. Here, it may include a binder resin appropriately selected from heretofore known binder resins. A weight-average molecular weight of the adhesive base is not particularly restricted, and it may be appropriately selected according to purpose. Nonetheless, it is preferably 3,000 or greater, more preferably 5,000 to 1,000,000, and particularly preferably 7,000 to 500,000. When the weight-average molecular weight is less than 3,000, hot-offset resistance may degrade.

A glass transition temperature (Tg) of the adhesive base is not particularly restricted, and it may be appropriately selected according to purpose. For example, it is preferably 30° C. to 70° C., and more preferably 40° C. to 65° C. When the glass transition temperature (Tg) is less than 30° C., heat-resistant storage stability of the toner may degrade. When it exceeds 70° C., low-temperature fixing property may be insufficient. The electrophotographic toner of this embodiment exhibits favorable storage stability despite a low glass transition temperature compared to a conventional polyester toner because of coexisting polyester resins formed by crosslinking reaction or elongation reaction.

The glass transition temperature (Tg) may be measured according to the following method using, for example, a TG-DSC system TAS-100 (manufactured by Rigaku Corporation). First, about 10 mg of a toner is placed in a sample container made of aluminum, and the sample container is mounted on a holder unit and set in an electric furnace. It is heated from a room temperature to 150° C. at a heating rate of 10° C./min and then allowed to stand at 150° C. for 10 minutes. Then, the sample is cooled to a room temperature and allowed to stand for 10 minutes. Thereafter, under a nitrogen atmosphere, it is heated to 150° C. at a heating rate of 10° C./min and a DSC curve is measured by a differential scanning calorimeter (DSC). From the obtained DSC curve, using an analysis system of the TG-DSC system TAS-100 system, the glass transition temperature (Tg) is calculated from a contact point of a tangent of an endothermic curve near the glass transition temperature (Tg) and a baseline.

The resin for the adhesive base is not particularly restricted, and it may be appropriately selected according to purpose. Nonetheless, a polyester resin is particularly preferable. The polyester resin is not particularly restricted and may be appropriately selected according to purpose. Nonetheless, a urea-modified polyester resin is particularly favorable, for example. The urea-modified polyester resin is obtained by reacting amines (B) as a compound having an active hydrogen group and an isocyanate group-containing polyester prepolymer (A) as the binder resin precursor having a site capable of reacting with the compound having an active hydrogen group in an aqueous medium. The urea-modified polyester resin may include a urethane bond other than a urea bond. In this case, a molar ratio between the urea bond and the urethane bond (urea bond/urethane bond) is not particularly restricted, and it may be appropriately selected according to purpose. Nonetheless, it is preferably 100/0 to 10/90, more preferably 80/20 to 20/80, and particularly preferably 60/40 to 30/70. When the above molar ratio is less than 10/90, hot-offset resistance may degrade.

Specific examples of the favorable urea-modified polyester resin include the following.

(1) A mixture of: a polyester prepolymer obtained by reacting a polycondensate of 2-mole ethylene-oxide adduct of bisphenol A and isophthalic acid with isophorone diisocyanate, which is urea-modified with isophoronediamine; and a polycondensate of 2-mole ethylene-oxide adduct of bisphenol A and isophthalic acid (2) A mixture of: a polyester prepolymer obtained by reacting a polycondensate of 2-mole ethylene-oxide adduct of bisphenol A and isophthalic acid with isophorone diisocyanate, which is urea-modified with isophoronediamine; and a polycondensate of 2-mole ethylene-oxide adduct of bisphenol A and terephthalic acid (3) A mixture of: a polyester prepolymer obtained by reacting a polycondensate of 2-mole ethylene-oxide adduct of bisphenol A/2-mole propylene-oxide adduct of bisphenol A and terephthalic acid with isophorone diisocyanate, which is urea-modified with isophoronediamine; a polycondensate of 2-mole ethylene-oxide adduct of bisphenol A/2-mole propylene-oxide adduct of bisphenol A and terephthalic acid (4) A mixture of: a polyester prepolymer obtained by reacting a polycondensate of 2-mole ethylene-oxide adduct of bisphenol A/2-mole propylene-oxide adduct of bisphenol A and terephthalic acid with isophorone diisocyanate, which is urea-modified with isophoronediamine; a polycondensate of 2-mole propylene-oxide adduct of bisphenol A and terephthalic acid (5) A mixture of: a polyester prepolymer obtained by reacting a polycondensate of 2-mole ethylene-oxide adduct of bisphenol A and terephthalic acid with isophorone diisocyanate, which is modified with hexamethylene diamine; and a polycondensate of 2-mole ethylene-oxide adduct of bisphenol A and terephthalic acid (6) A mixture of: a polyester prepolymer obtained by reacting a polycondensate of 2-mole ethylene-oxide adduct of bisphenol A and terephthalic acid with isophorone diisocyanate, which is modified with hexamethylene diamine; and a polycondensate of 2-mole ethylene-oxide adduct of bisphenol A/2-mole propylene-oxide adduct of bisphenol A and terephthalic acid (7) A mixture of: a polyester prepolymer obtained by reacting a polycondensate of 2-mole ethylene-oxide adduct of bisphenol A and terephthalic acid with isophorone diisocyanate, which is urea-modified with ethylene diamine; and a polycondensate of 2-mole ethylene-oxide adduct of bisphenol A and terephthalic acid (8) A mixture of: a polyester prepolymer obtained by reacting a polycondensate of 2-mole ethylene-oxide adduct of bisphenol A and isophthalic acid with diphenylmethane diisocyanate, which is urea-modified with hexamethylene diamine; and a polycondensate of 2-mole ethylene-oxide adduct of bisphenol A and isophthalic acid (9) A mixture of: a polyester prepolymer obtained by reacting a polycondensate of 2-mole ethylene-oxide adduct of bisphenol A/2-mole propylene-oxide adduct of bisphenol A and terephthalic acid/dodecenylsuccinic anhydride with diphenylmethane diisocyanate, which is urea-modified with hexamethylene diamine; and a polycondensate of 2-mole ethylene-oxide adduct of bisphenol A/2-mole propylene-oxide adduct of bisphenol A and terephthalic acid

(10) A mixture of: a polyester prepolymer obtained by reacting a polycondensate of 2-mole ethylene-oxide adduct of bisphenol A and isophthalic acid with toluene diisocyanate, which is urea-modified with hexamethylene diamine; and a polycondensate of 2-mole ethylene-oxide adduct of bisphenol A and isophthalic acid The adhesive base (for example, a urea-modified polyester resin) may be formed by, for example, (1) emulsifying or dispersing a solution or a dispersion liquid of toner materials including the binder resin precursor having a site capable of reacting with the compound having an active hydrogen group (for example, isocyanate group-containing polyester prepolymer (A)) in the aqueous medium with the compound having an active hydrogen group (for example, amines (B)) to form oil droplets and subjecting them to an elongation reaction or a crosslinking reaction in the aqueous medium, or (2) emulsifying or dispersing the solution or dispersion liquid of toner materials in aqueous medium in which the compound having an active hydrogen group is added beforehand to form oil droplets and subjecting them to an elongation reaction or a crosslinking reaction in the aqueous medium. Alternatively, it may be produced by (3) adding and mixing the solution or dispersion liquid of toner materials in the aqueous medium followed by adding the compound having an active hydrogen group to form oil droplets and subjecting them to an elongation reaction or a crosslinking reaction in the aqueous medium from particle interfaces. Here, in case of (3), the modified polyester resin is predominantly formed on a surface of the toner being formed, and a concentration gradient may be allocated on the toner particles.

Reaction conditions for forming the adhesive base by emulsification or dispersion are not particularly restricted, and they may be appropriately selected depending on a combination of the binder resin precursor having a site capable of reacting with the compound having an active hydrogen group and the compound having an active hydrogen group. Here, a reaction time is preferably 10 minutes to 40 hours, and more preferably 2 hours to 24 hours.

As a method for stably forming a dispersion body including the binder resin precursor having a site capable of reacting with the compound having an active hydrogen group (for example, isocyanate group-containing polyester prepolymer (A)) in the aqueous medium, for example, the solution or dispersion liquid of toner materials prepared by dissolving or dispersing the toner materials such as binder resin precursor having a site capable of reacting with the compound having an active hydrogen group (for example, isocyanate group-containing polyester prepolymer (A)), the colorant, the releasing agent, the charge controlling agent, the non-modified polyester resin and so on in an organic solvent is added in the aqueous medium, and it is dispersed by a shearing force.

An amount of the aqueous medium used in the emulsification or dispersion is preferably 50 parts by mass to 2,000 parts by mass, and more preferably 100 parts by mass to 1,000 parts by mass with respect to 100 parts by mass of the toner materials. When the amount used is less than 50 parts by mass, the toner materials are poorly dispersed, and there are cases where toner particles having a predetermined particle diameter cannot be obtained. When it exceeds 2,000 parts by mass, a production cost increases.

In the emulsification or dispersion, a dispersant is preferably used according to necessity for stabilizing the oil droplets and for sharpening the particle size distribution while obtaining a desired shape. The dispersant is not particularly restricted, and it may be appropriately selected according to purpose. Examples thereof include surfactants, hardly water-soluble inorganic compound dispersants, polymeric protective colloid and so on. These may be used alone or in combination of two or more. Among these, the surfactants are preferable.

Examples of the polymeric protective colloid include acids, (meth)acrylic monomers containing a hydroxyl group, vinyl alcohol or ethers of vinyl alcohol, esters of vinyl alcohol and a compound containing a carboxyl group, amide compounds and methylol compounds thereof, chlorides, homopolymers or copolymers of units containing a nitrogen atom or a heterocycle thereof, polyoxyethylenes, celluloses and so on. Examples of the acids include acrylic acid, methacrylic acid, α-cyanoacrylic acid, β-cyanomethacrylic acid, itaconic acid, crotonic acid, fumaric acid, maleic acid, maleic anhydride and so on. Examples of the (meth)acrylic monomer containing a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, n-methylol acrylamide, n-methylol methacrylamide and so on.

Examples of the vinyl alcohol or ethers of vinyl alcohol include vinyl methyl ether, vinyl ethyl ether, vinyl propyl ether and so on. Also, examples of the esters of vinyl alcohol and a compound containing a carboxyl group include vinyl acetate, vinyl propionate, vinyl butyrate and so on. Also, examples of the amide compounds and the methylol compounds thereof include acrylamide, methacrylamide, diacetone acrylamide acid, and methylol compounds thereof.

Examples of the chlorides include acrylic acid chloride, methacrylic acid chloride and so on. Also, homopolymers or copolymers of units containing a nitrogen atom or a heterocycle thereof include vinyl pyridine, vinyl pyrrolidone, vinyl imidazole, ethylene imine and so on.

Examples of the polyoxyethylenes include polyoxyethylene, polyoxypropylene, polyoxyethylene alkyl amine, polyoxypropylene alkyl amine, polyoxyethylene alkyl amides, polyoxypropylene alkyl amides, polyoxyethylene nonylphenyl ether, polyoxyethylene laurylphenyl ether, polyoxyethylene stearylphenyl ester, polyoxyethylene nonylphenyl ester and so on. Also, examples of the celluloses include methyl cellulose, hydroxyethyl cellulose, hydroxypropyl cellulose and so on.

When a dispersion stabilizer which may be dissolved in an acid or an alkali such as calcium phosphate salts and so on, it is possible to remove the calcium phosphate salts from the fine particles by, for example, dissolving the calcium phosphate salts by an acid such as hydrochloric acid and so on followed by washing with water or by decomposing with an enzyme.

—Anionic Surfactant—

Examples of the anionic surfactants used in the manufacturing method of the present invention include alkylbenzene sulfonate, α-olefin sulfonate, phosphate esters and so on, and anionic surfactants containing a fluoroalkyl group are favorable. Examples of the anionic surfactants containing a fluoroalkyl group include a fluoroalkylcarboxylic acid (C2 to C10) or metal salts thereof, disodium perfluorooctane sulfonyl glutamate, sodium 3-[ω-fluoroalkyl (C6 to C11) oxy]-1-alkyl (C3 to C4)sulfonate, sodium 3-[ω-fluoroalkanoyl (C6 to C8)-N-ethylamino]-1-propane sulfonate, fluoroalkyl (C11 to C20) carboxylic acid or metal salts thereof, perfluoroalkylcarboxylic acid (C7 to C13) or metal salts thereof, perfluoroalkyl (C4 to C12) sulfonic acid or metal salts thereof, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethyl sulfonyl glycine salts, monoperfluoroalkyl (C6 to C16) ethyl phosphate esters and so on.

Examples of commercial products of anionic surfactants having a fluoroalkyl group include: SURFLON S-111, S-112, S-113 (manufactured by Asahi Glass Co., Ltd.); FLUORAD FC-93, FC-95, FC-98, FC-129 (manufactured by Sumitomo 3M Ltd.); UNIDYNE DS-101, DS-102 (manufactured by Daikin Industries, Ltd.); MEGAFACE F-110, F-120, F-113, F-191, F-812, F-833 (manufactured by DIC Corporation); EFTOP EF-102, 103, 104, 105, 112, 123A, 123B, 306A, 501, 201, 204 (manufactured by Tochem Products Inc.); FTERGENT F-100, F150 (manufactured by Neos Company Ltd.), and so on.

<<Removal of Organic Solvent>>

The organic solvent is removed from emulsified slurry obtained by emulsification or dispersion. Exemplary methods for removing the organic solvent include: (1) gradually heating the whole reaction system to completely evaporate and remove the organic solvent in the oil droplets; (2) spraying the emulsified dispersion in a dry atmosphere to completely remove the non-water-soluble organic solvent in the oil droplets and to form toner particles and additionally evaporating and removing the aqueous dispersant, and so on. Once the organic solvent is removed, toner particles are formed. The toner particles thus formed are subjected to washing, drying and so on, further followed by classification and so on, if desired. The classification is carried out by removing a fine-particle portion in a liquid by a cyclone, a decanter, a centrifuge and so on. Here, classification operation may be carried out on a powder obtained after drying.

(Image Forming Apparatus and Image Forming Method)

An image forming apparatus of the present invention includes: an electrostatic latent image bearing member; an electrostatic latent image forming unit (a charger and an exposure device); a developing unit; a transfer unit; a fixing unit; and a cleaning unit, and it may further include other units such as neutralizing unit, recycling unit, controlling unit and so on according to necessity.

An image forming method of the present invention includes: an electrostatic latent image forming step (charging and exposure); a developing step; a transfer step; a fixing step; and a cleaning step, and it may further include other steps such as neutralizing step, recycling step, controlling step and so on according to necessity.

<Electrostatic Latent Image Bearing Member>

A material, shape, structure, size and so on of the electrostatic image bearing member (hereinafter, it may also be referred to as an "image bearing member" or a "photoconductor") may be appropriately selected from heretofore known ones. Examples of the material include: inorganic materials such as amorphous silicon, selenium and so on; and organic materials such as polysilane, phthalopolymethine and so on, and the amorphous silicon for its long service life. Also, the shape is preferably a drum.

<Electrostatic Latent Image Forming Unit and Electrostatic Latent Image Forming Step>

The electrostatic latent image forming unit is a unit for forming an electrostatic latent image on the electrostatic image bearing member. The electrostatic latent image forming step is a step for forming an electrostatic latent image on the electrostatic image bearing member. The electrostatic latent image forming step may be favorably carried out by the electrostatic latent image forming unit.

The electrostatic latent image may be formed by uniformly charging a surface of the image bearing member followed by an image-wise exposure, and it may be carried out by the electrostatic latent image forming unit. The electrostatic latent image forming unit preferably includes a charger (charging unit) which uniformly charges the surface of the image bearing member, and an exposure device (exposure unit) which exposes the surface of the image bearing member.

The charging may be carried out by applying a voltage on the surface of the image bearing member using the charger. The charger may be appropriately selected according to purpose. Nonetheless, heretofore known contact charger, non-contact charger which makes use of corona discharge such as corotron, scorotron and so on, and so on equipped with an electrically conductive or semiconductive roller, brush, film, rubber blade and so on may be exemplified.

The exposure may be carried out by exposing the surface of the image bearing member using the exposure device. The exposure device may be appropriately selected according to purpose. Nonetheless, various exposure devices such as duplication optical system, rod lens array system, laser optical system, liquid crystal shutter optical system and so on may be used. Here, a back-light system which carries out an exposure from a back surface of the image bearing member may be employed.

<Developing Unit and Developing Step>

The developing unit is a developing unit which is equipped with the toner of the present invention and forms a visible image by developing the electrostatic latent image with the toner. The developing step is a step for forming a visible image by developing an electrostatic latent image with the toner of the present invention. The developing step may be favorably carried out by the developing unit.

The visible image may be formed using the developing unit. The developing unit may be appropriately selected from heretofore known ones, and it favorably includes a developing device which contains the toner of the present invention and may impart the toner to the electrostatic latent image in a contact or non-contact manner. The developing device may be of a dry development method or a wet development method. Also, it may be of a single-color developing device or a multi-color developing device. Specific examples thereof include a developing device including a stirrer which charges the developer by frictional stirring and a rotatable magnet roller and so on. A developer contained in the developing device is a developer which uses the toner of the present invention, and it may be a one-component developer or a two-component developer.

In the developing device including the two-component developer, the toner and a carrier are mixed and stirred, and the toner is charged by the friction generated at that time. The toner is held in a state of ear standing on a surface of the rotating magnet roller, and a magnetic brush is formed. Since the magnet roller is arranged in a vicinity of the image bearing member, a part of the toner which constitutes the magnetic brush formed on the surface of the magnet roller is transferred to the surface of the image bearing member by an electrical attraction force. As a result, the electrostatic latent image is developed by the toner, and a visible image is formed by the toner on the surface of the image bearing member.

<Transfer Unit and Transfer Step>

The transfer unit is a unit for transferring the visible image on the electrostatic latent image bearing member to a recording medium. The transfer step is a step for transferring the visible image on the electrostatic latent image bearing member to a recording medium. The transfer step may be favorably carried out by the transfer unit.

The transfer step preferably includes a primary transfer of the visible image to an intermediate transfer member using an intermediate transfer member and a secondary transfer of the visible image to the recording medium. At this time, as the toner to be used, a monochrome, a full-color or a transparent toner may be used. Usually, two or more colors are simultaneously interposed and developed, and thus it more preferably includes a primary transfer step which forms a composite transfer image by transferring the visible image on an intermediate transfer member and a secondary transfer step which transfers the composite transfer image on a recording medium.

The transfer may be carried out by charging the image bearing member using the transfer unit. The transfer unit preferably includes a primary transfer unit which transfers the visible image on the intermediate transfer member to form the composite transfer image and a secondary transfer unit which transfers the composite transfer image to the recording medium. Here, the intermediate transfer member may be appropriately selected from heretofore known transfer bodies according to purpose, and a transfer belt and so on may be used.

The transfer unit preferably includes a transfer device which peels off and charges the visible image formed on the image bearing member to a side of the recording medium. The transfer unit may be one, or two or more. Specific examples of the transfer device include a corona transfer device by corona discharge, a transfer belt, a transfer roller, a pressure transfer roller, an adhesive transfer device and so on. Here, the recording medium may be appropriately selected from heretofore known recording media, and recording paper and so on may be used.

<Fixing Unit and Fixing Step>

The fixing unit is a unit for fixing a transfer image transferred on the recording medium. The fixing step is a step for fixing the transfer image transferred on the recording medium. The fixing step may be preferably carried out by the fixing unit.

The fixing step is a step for fixing the visible image transferred on the recording medium using the fixing unit. The fixing may be carried out every time a toner of one color is transferred on the recording medium, or it may be carried out once when the toners of respective colors are laminated. The fixing unit may be appropriately selected according to purpose. Nonetheless, a heretofore known heating and pressurizing unit may be used. Examples of the heating and pressurizing unit include a combination of a heat roller and a pressure roller, a combination of a heat roller, a pressure roller and an endless belt and so on. Heating in the heating and pressurizing unit is preferably carried out at 80° C. to 200° C. Here, a heretofore known optical fixing device may be used according to purpose with or in place of the fixing step and the fixing unit, for example.

<Cleaning Unit and Cleaning Step>

The cleaning unit is a unit for removing a toner remaining on the image bearing member. The cleaning step is a step for removing a toner remaining on the image bearing member. The cleaning step may be favorably carried out by the cleaning unit.

The cleaning unit may be appropriately selected from heretofore known cleaners, and a magnetic brush cleaner, an electrostatic brush cleaner, a magnetic roller cleaner, a blade cleaner, a brush cleaner, a web cleaner and so on may be used. It is preferable to use the blade cleaner.

The neutralizing step is a step for neutralizing the image bearing member by applying a neutralizing bias, and it may be carried out using a neutralizing unit.

The neutralizing unit may be appropriately selected from heretofore known neutralizing devices, and a neutralizing lamp and so on may be used.

The controlling step is a step for controlling the above steps, and it may be carried out using a controlling unit. The controlling unit may be appropriately selected according to purpose, and devices such as sequencer, computer and so on may be used.

A process cartridge of the present invention is used for the image forming apparatus of the present invention. It integrally support an image bearing member, and at least one unit selected from the charging unit, the developing unit and the cleaning unit, and it is detachably attached to the image forming apparatus main body of the present invention.

FIG. 1 illustrates one example of an image forming apparatus used in the present invention. An image forming apparatus 100A is equipped with: a drum-shaped photoconductor 10 as an image bearing member; a charging roller 20 as a charging unit, an exposure apparatus 30 as an exposure unit, a developing apparatus 40 as a developing unit, an intermediate transfer member 50, a cleaning apparatus 60 as a cleaning unit, and a neutralizing lamp 70 as a neutralizing unit.

The intermediate transfer member 50 is an endless belt, stretched by three (3) rollers 51 so that it can move in a direction of the arrow. A part of the three (3) rollers 51 also functions as a transfer bias roller which may apply a predetermined transfer bias (primary transfer bias) on the intermediate transfer member 50. In a vicinity of the intermediate transfer member 50, a cleaning apparatus 90 including a cleaning blade is arranged. Also, a transfer roller 80 which can apply a transfer bias for transferring (secondary transfer) the visible image (toner image) on recording paper 95 as a recording medium is disposed facing the intermediate transfer member. In a periphery of the intermediate transfer member 50, a corona charger 58 for applying a charge to the toner image on the intermediate transfer member 50 is disposed between a contact portion of the photoconductor 10 with the intermediate transfer member 50 and a contact portion of the intermediate transfer member 50 with the transfer paper 95 in a direction of rotation of the intermediate transfer member 50.

The developing apparatus 40 is configured with: a developing belt 41 as a developer bearing member; and a black developing device 45K, a yellow developing device 45Y, a magenta developing device 45M and a cyan developing device 45C disposed around the developing belt 41. Here, the black developing device 45K is equipped with a developer container 42K, a developer supply roller 43K and a developing roller 44K; the yellow developing device 45Y is equipped with a developer container 42Y, a developer supply roller 43Y and a developing roller 44Y; the magenta developing device 45M is equipped with a developer container 42M, a developer supply roller 43M and a developing roller 44M, a cyan developing device 45C is equipped with a developer container 42C, a developer supply roller 43C and a developing roller 44C. Also, the developing belt 41 is an endless belt, stretched by a plurality of belt rollers so that it moves in a direction of the arrow, and a part thereof is in contact with the photoconductor 10.

In the image forming apparatus 100A, the photoconductor 10 is uniformly charged by the charging roller 20, then the photoconductor 10 is exposed using the exposure apparatus 30, and the electrostatic latent image is formed. Next, the electrostatic latent image formed on the photoconductor 10 is developed by supplying a developer from the developing apparatus 40, and a toner image is formed. Further, the toner image is transferred (primary transfer) on the intermediate transfer member 50 by the voltage applied by the roller 51, and then transferred (secondary transfer) on the recording paper 95. As a result, a transfer image is formed on the recording paper 95. Here, a toner remaining on the photoconductor 10 is removed by the cleaning apparatus 60 including the cleaning blade, and the charge of the photoconductor 10 is neutralized by the neutralizing lamp 70.

Figure 2:
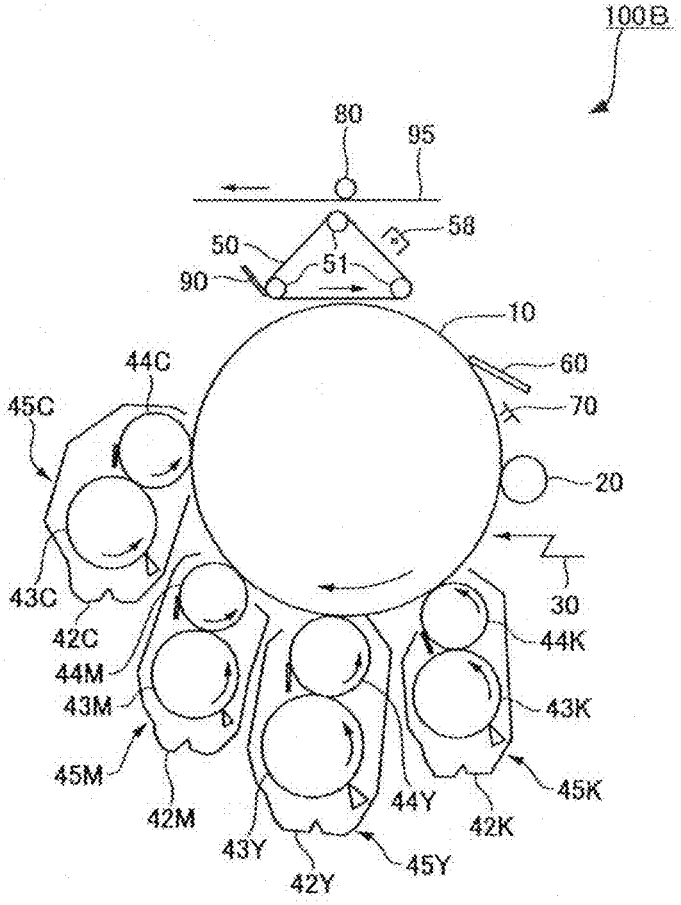
FIG. 2 is a schematic explanatory diagram illustrating another example of an image forming apparatus used in the present invention.

FIG. 2 illustrates another example of an image forming apparatus used in the present invention. An image forming apparatus 100B has the same configuration and the same effect as the image forming apparatus 100A except that the developing belt 41 is not provided and that, around the photoconductor drum 10, the black developing unit 45K, the yellow developing unit 45Y, the magenta developing unit 45M and the cyan developing unit 45C are disposed to face directly to the photoconductor drum 10. Here, in FIG. 2, elements equivalent to those in FIG. 1 are identified by the same signs.

Figure 3:
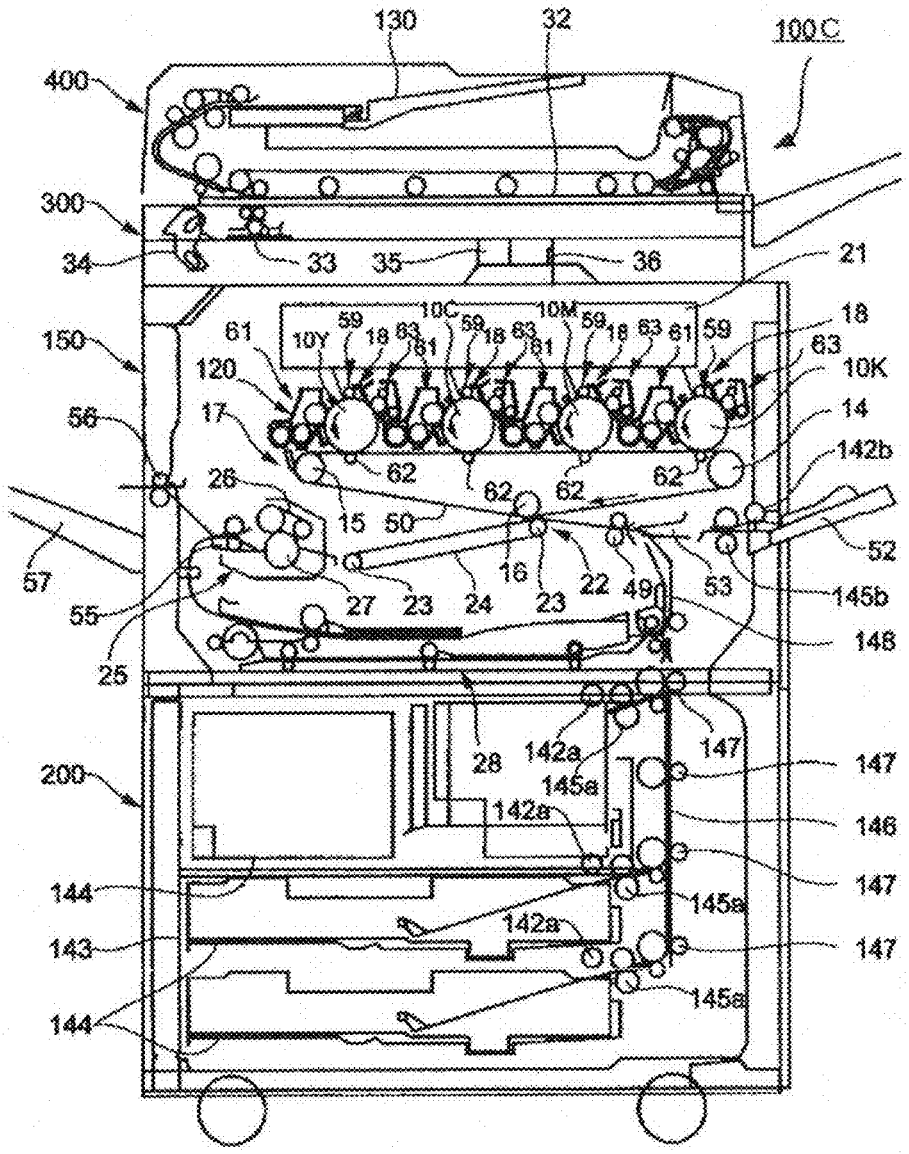
FIG. 3 is a schematic explanatory diagram illustrating another example of an image forming apparatus used in the present invention.

FIG. 3 illustrates another example of an image forming apparatus used in the present invention. An image forming apparatus 100C is a tandem color image forming apparatus. The image forming apparatus 100C is equipped with a copying apparatus main body 150, a paper feed table 200, a scanner 300, and an automatic document feeder 400. In the copying apparatus main body 150, an intermediate transfer member 50 as an endless belt is provided at a central portion thereof. Also, the intermediate transfer member 50 is stretched by support roller 14, 15 and 16 so that it may move in a clockwise direction in the figure. In a vicinity of the support roller 15, an intermediate transfer member cleaning apparatus 17 is disposed to remove a toner remaining on the intermediate transfer member 50. A tandem developing device 120 that four (4) colors image forming units 18 of yellow, cyan, magenta and black are arranged in parallel is disposed facing the intermediate transfer member 50 stretched by the support rollers 14 and 15 in a conveying direction thereof. In a vicinity of the tandem developing device 120, an exposure apparatus 21 is disposed. A secondary transfer apparatus 22 is disposed on a side of the intermediate transfer member 50 opposite to the side of the tandem developing device 120. In the secondary transfer apparatus 22, a secondary transfer belt 24 as an endless belt is stretched by a pair of rollers 23, and recording paper conveyed on the secondary transfer belt 24 and the intermediate transfer member 50 may contact with each other. A fixing apparatus 25 is disposed in a vicinity of the secondary transfer apparatus 22. The fixing apparatus 25 is equipped with a fixing belt 26 as an endless belt and a pressure roller 27 pressed by the fixing belt 26.

Here, in the image forming apparatus 100C, a sheet inverting apparatus 28 is disposed in a vicinity of the secondary transfer apparatus 22 and the fixing apparatus 25 for inverting the transfer paper. Thereby, images may be formed on both sides of recording paper.

Next, formation of a full-color image using the tandem developing device 120 (color copy) is explained. First, a document is set on a document table 130 of the automatic document feeder 400. Alternatively, the automatic document feeder 400 is opened, the document is set on a contact glass 32 of the scanner 300, and the automatic document feeder 400 is closed.

The scanner 300 activates after the document is conveyed and transferred to the contact glass 32 in the case the document has been set on the automatic document feeder 400, or right away in the case the document has been set on the contact glass 32, and a first traveling body 33 and a second travelling body 34 travel. At this time, a light is irradiated from the first traveling body 33 and is reflected by a surface of the document. The reflected light is reflected by a mirror of the second travelling body 34 and received by a reading sensor 36 through an imaging lens 35. Thereby, the color document (color image) is read, and image information of respective colors, namely black, yellow, magenta and cyan, are obtained. The image information of the respective colors are transmitted to the image forming unit 18 of the respective colors in the tandem developing device 120, and toner images of the respective colors are formed.

The toner image on the black photoconductor 10K, the toner image on the yellow photoconductor 10Y, the toner image on the magenta photoconductor 10M and the toner image on the cyan photoconductor 10C are sequentially transferred (primary transfer) on the intermediate transfer member 50. Then, the toner images of the respective colors are superimposed on the intermediate transfer member 50, and a composite color image (color transfer image) is formed.

Figure 4:
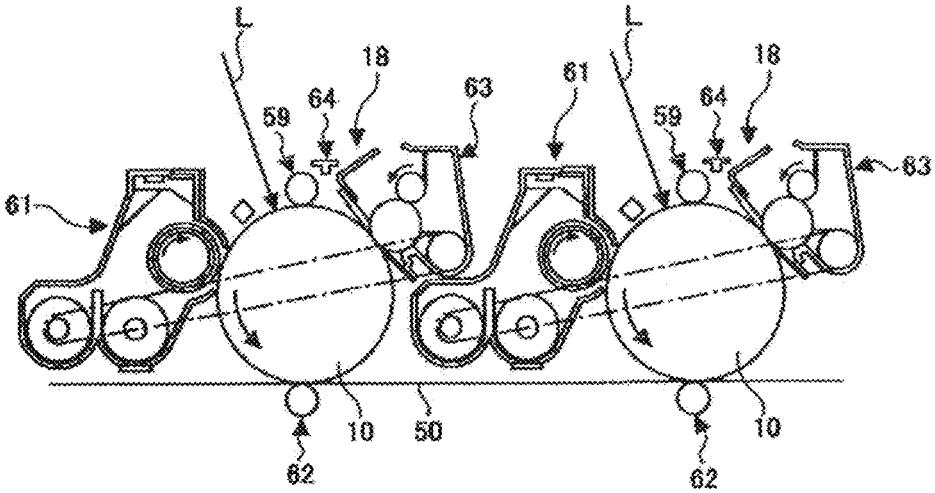
FIG. 4 is a schematic explanatory diagram illustrating a part of the image forming apparatus of FIG. 3.

As illustrated in FIG. 4, each of the image forming unit 18 of the respective colors in the tandem developing device 120 includes: a photoconductor 10; a charger 59 which uniformly charges the photoconductor 10; an exposure apparatus 21 which exposes (L, in the figure) the photoconductor 10 based on the image information of the respective colors to form an electrostatic latent image on the photoconductor 10; a developing device 61 which develops the electrostatic latent image using a toner of the respective color to form a toner image of the respective color on the photoconductor 10; a transfer charger 62 which transfers the toner image of the respective color on the intermediate transfer member 50; a photoconductor cleaning apparatus 63; and a neutralizing device 64.

Meanwhile, in the paper feed table 200, one of paper-feed rollers 142*a* is selectively rotated to feed recording paper from one of paper cassettes 144 equipped in multiple stages in a paper bank 143. The recording paper is separated one by one by a separation roller 145*a* and sent to a feed path 146. Each recording paper is conveyed by a conveying roller 147 and guided to a feed path 148 of the copier main body, and it is stopped by striking a registration roller 49. Alternatively, a paper-feed roller 142*b* is rotated to feed recording paper on a manual feed tray 52. The recording paper is separated one by one by a separation roller 145*b* and guided to a manual feed path 53, and it is stopped similarly by striking the registration roller 49. Here, the registration roller 49 is generally used while grounded, but it may be used in a state that a bias is applied for removing paper dust on the sheet.

Next, by rotating the registration roller 49 in accordance with the timing of the color transfer image formed on the intermediate transfer member 50, the recording paper is fed between the intermediate transfer member 50 and the secondary transfer apparatus 22. Thereby, the color transfer image is formed on the recording paper. Here, the toner remaining on the intermediate transfer belt 50 after transfer is cleaned by the intermediate transfer member cleaning apparatus 17.

The recording paper on which the color transfer image is formed is conveyed to the fixing apparatus 25 by the secondary transfer apparatus 22, and the color transfer image is fixed on the recording paper by heat and pressure. Thereafter, the recording paper is switched by a switching claw 55, and it is discharged by a discharge roller 56 and stacked on a discharge tray 57. Alternatively, the recording paper is switched by the switching claw 55, inverted by a sheet inverting apparatus 28 and guided again to the transfer position. An image is formed on a rear surface as well, and then it is discharged by the discharge roller 56 and stacked on the discharge tray 57.

A process cartridge related to the present invention is used in the image forming apparatus of the present invention. It integrally supports an image bearing member and at least any one apparatus selected from a charging apparatus, a developing apparatus, and a cleaning apparatus, and it is detachably attached to the image forming apparatus main body.

EXAMPLES

Hereinafter, the present invention is further explained in detail with examples and comparative examples. Here, the present invention is not limited to the described examples and comparative example. "Part" and "%" in the example denote "parts by mass" and "% by mass", respectively, unless otherwise specified.

[Production of Toner]

Specific preparation examples of toners used for evaluation are explained. The toner used in the present invention is not limited to these examples.

Example 1

Toner Base Particles A

—Synthesis of Crystalline Polyester Resin—

A 5-L four-necked flask equipped with a nitrogen inlet tube, a dehydration tube, a stirrer and a thermocouple was charged with 2,300 g of 1,6-alkanediol, 2,530 g of fumaric acid, 291 g of trimellitic anhydride, and 4.9 g of hydroquinone. It was reacted first at 160° C. for 5 hours, then heated to 200° C. and reacted for 1 hour, and further reacted at 8.3 kPa for 1 hour, and thereby [Crystalline Polyester Resin 1] was obtained. [Crystalline Polyester Resin 1] had an endothermic peak temperature of DSC of 120° C., Mn of 1,500, Mw of 9,000, and an SP value of 10.8.

—Synthesis of Non-Crystalline Polyester (Low-Molecular-Weight Polyester) Resin—

A 5-L four-necked flask equipped with a nitrogen inlet tube, a dehydration tube, a stirrer and a thermocouple was charged with 229 parts of 2-mole ethylene-oxide adduct of bisphenol A, 529 parts of 3-mole propylene oxide adduct of bisphenol A, 208 parts of terephthalic acid, 46 parts of adipic acid, and 2 parts of dibutyltin oxide. It was reacted at a normal pressure and at 230° C. for 7 hours and then reacted at a reduced pressure of 10 mmHg to 15 mmHg for 4 hours. Then, 44 parts of trimellitic anhydride was added to the reactor, and it was reacted at 180° C. and at a normal pressure for 2 hours. Thereby, [Non-Crystalline Polyester 1] was obtained. [Non-Crystalline Polyester 1] had a number-average molecular weight (Mn) of 2,200, a weight-average molecular weight (Mw) of 5,800, and a glass transition temperature (Tg) of 55° C.

—Synthesis of Polyester Prepolymer—

A reactor equipped with a cooling tube, a stirrer and a nitrogen inlet tube was charged with 682 parts of 2-mole ethylene-oxide adduct of bisphenol A, 81 parts of 2-mole propylene-oxide adduct of bisphenol A, 283 parts of terephthalic acid, 22 parts of trimellitic anhydride, and 2 parts of dibutyltin oxide. It was reacted at a normal pressure and at 230° C. for 8 hours and further reacted at a reduced pressure of 10 mmHg to 15 mmHg for 5 hours, and thereby [Intermediate Polyester 1] was obtained. [Intermediate Polyester 1] had a number-average molecular weight of 2,100, a weight-average molecular weight of 9,500, Tg of 55° C., an acid value of 0.5, and a hydroxyl value of 51.

Next, a reactor equipped with a cooling tube, a stirrer and a nitrogen inlet tube was charged with 410 parts of [Intermediate Polyester 1], 89 parts of isophorone diisocyanate, and 500 parts of ethyl acetate. It was reacted at 100° C. for 5 hours, and thereby [Prepolymer 1] was obtained. [Prepolymer 1] had free isocyanate % of 1.53%.

—Synthesis of Ketimine—

A reactor equipped with a stirring rod and a thermometer was charged with 170 parts of isophoronediamine and 75 parts of methyl ethyl ketone. It was reacted at 50° C. for 5 hours, and [Ketimine Compound 1] was obtained. [Ketimine Compound 1] had an amine value of 418.

—Preparation of Masterbatch (MB)—

First, 1,200 parts of water, 540 parts of carbon black (PRINTEX35, manufactured by Evonik Degussa) [DBP oil absorption=42 mL/100 mg, pH=9.5], and 1,200 parts of [Non-Crystalline Polyester Resin 1] were added and mixed in a HENSCHEL mixer (manufactured by Nippon Coke & Engineering. Co., Ltd.). Then, the mixture was kneaded using a two-roll mill at 150° C. for 30 minutes, rolled and cooled, and then pulverized with a pulverizer. Thereby, [Masterbatch 1] was obtained.

—Preparation of Oil Phase—

A container equipped with a stirring rod and a thermometer was charged with 378 parts of Non-Crystalline Polyester 1], 110 parts of a carnauba wax, 22 parts of charge controlling agent (CCA, salicylic acid metal complex E-84, manufactured by Orient Chemical Industries Co., Ltd.), and 947 parts of ethyl acetate. It was heated to 80° C. with stirring, retained at 80° C. for 5 hours and cooled to 30° C. over 1 hour. Next, the container was charged with 500 parts of [Masterbatch 1] and 500 parts of ethyl acetate, which was mixed for 1 hour, and thereby [Raw-Material Solution 1] was obtained.

Then, 1,324 parts of [Raw-Material Solution 1] was transferred to a container, and using a bead mill (ULTRA VISCO MILL, manufactured by Aimex Co., Ltd.) packed by 80% by volume with 0.5-mm zirconia beads, the carbon black and the wax were dispersed by running 3 passes under the conditions of a liquid feed rate 1 kg/hr and a peripheral speed of a disk of 6 m/second. Next, 1042.3 parts of a 65-% ethyl acetate solution of [Non-Crystalline Polyester 1] was added, and by running 1 pass with the bead mill under the above conditions, [Pigment-Wax Dispersion Liquid 1] was obtained. A solid content concentration of [Pigment-Wax Dispersion Liquid 1] (130° C., 30 minutes) was 50%.

—Preparation of Dispersion Liquid of Crystalline Polyester—

A 2-L container made of metal was charged with 100 g of [Crystalline Polyester Resin 1] and 400 g of ethyl acetate. It was heated and dissolved at 75° C., and then quenched in an ice-water bath at a rate of 27° C./min. To this, 500 mL of glass beads (3 mm ϕ) was added, and it was subjected to pulverization for 10 hours in a batch-type sand mill apparatus. Thereby, [Crystalline Polyester Dispersion Liquid 1] was obtained.

—Synthesis of Organic-Particle Emulsion—

A reactor equipped with a stirring rod and a thermometer was charged with 683 parts of water, 11 parts of sodium salt of sulfuric acid ester of ethylene oxide adduct of methacrylic acid, manufactured by Sanyo Chemical Industries, Ltd.), 138 parts of styrene, 138 parts of methacrylic acid, and 1 part of ammonium persulfate. It was stirred at 400 rpm for 15 minutes, and a white emulsion was obtained. It was heated so that a temperature in the system was increased to 75° C. and reacted for 5 hours. Further, 30 parts of a 1-% aqueous solution of ammonium persulfate was added, and it was aged at 75° C. for 5 hours. Thereby, an aqueous dispersion liquid of a vinyl resin (a copolymer of styrene-methacrylic acid-sodium salt of sulfuric acid ester of ethylene oxide adduct of methacrylic acid) [Fine-Particle Dispersion Liquid 1] was obtained. [Fine-Particle Dispersion Liquid 1] had a volume-average particle diameter measured by LA-920 of 0.14 μm. A part of [Fine-Particle Dispersion Liquid 1] was dried, and a resin component was isolated.

—Preparation of Aqueous Phase—

A milky liquid was obtained by mixing and stirring 990 parts of water, 37 parts of a 48.5-% aqueous solution of dodecyl diphenyl ether sodium disulfonate (ELEMINOL MON-7, manufactured by Sanyo Chemical Industries, Ltd.), and 90 parts of ethyl acetate were mixed and stirred. This is referred to as [Aqueous Phase 1].

—Emulsification and Desolvation—

A container was charged with 664 parts of [Pigment-Wax Dispersion Liquid 1], 109.4 parts of [Prepolymer 1], 73.9 parts of [Crystalline Polyester Dispersion Liquid 1], and 4.6 parts of [Ketimine Compound 1], which was mixed by TK HOMOMIXER (manufactured by Primix Corporation) at 5,000 rpm for 1 minute. Then, 1,200 parts of [Aqueous Phase 1] was added to the container and mixed by TK HOMOMIXER at a rotational speed of 8,000 rpm for 60 seconds, and [Emulsified Slurry 1] was obtained.

[Emulsified Slurry 1] was placed in a container equipped with a stirrer and a thermometer and was subjected to desolvation at 30° C. for 8 hours followed by aging at 45° C. for 4 hours, and [Dispersion Slurry 1] was obtained.

—Washing and Drying—

After vacuum filtration of 100 parts of [Dispersion Slurry 1], the following operations were carried out.

(1): To the filter cake, 100 parts of ion-exchanged water was added, which was mixed with TK HOMOMIXER (at a rotational speed of 12,000 rpm for 10 minutes), followed by filtration.

(2): To the filter cake of (1), 100 parts of a 10-% aqueous solution of sodium hydroxide was added, which was mixed with TK HOMOMIXER (at a rotational speed of 12,000 rpm for 30 minutes), followed by vacuum filtration.

(3): To the filter cake of (2), 100 parts of 10-% hydrochloric acid was added, which was mixed with TK HOMOMIXER (at a rotational speed of 12,000 rpm for 10 minutes), followed by filtration.

(4): To the filter cake of (3), 300 parts of ion-exchanged water was added, which was mixed with TK HOMOMIXER (at a rotational speed of 12,000 rpm for 10 minutes), followed by filtration. This operation was repeated twice, and [Filter Cake 1] was obtained.

Thereafter, [Filter Cake 1] was dried in a wind dryer at 45° C. for 48 hours and sieved with a mesh having openings of 75 μm, and Toner Base Particles A were obtained.

(Production of External Additives)

Primary particles of silica having various average particle diameter described in Table 1 below and a treating agent were mixed and baked in a spray dryer to induce coalescence within the primary particles, and thereby External Additives a to q were produced. Also, in order to achieve a sharp particle size distribution as particles of the external additives, a classification process was carried out in a classification apparatus, and coalesced particles having the various average particle diameter described in Table 1 were prepared.

TABLE 1

| External Additive | Average primary particle diameter of silica (nm) |
|---|---|
| a | 43 |
| b | 53 |
| c | 53 |
| d | 21 |
| e | 59 |
| f | 64 |
| g | 147 |
| h | 22 |
| i | 36 |
| j | 47 |
| k | 113 |
| l | 28 |
| m | 53 |
| n | 54 |
| o | 107 |
| p | 28 |
| q | 59 |

<External Addition Treatment>

In a HENSCHEL mixer, 2.0 parts of Coalesced Silica a described in Table 2, 2.0 parts of silica having an average particle diameter of 20 nm, and 0.6 parts of titanium oxide having an average particle diameter of 20 nm were mixed to 100 parts of Toner Base Particles A. It was sieved with a 500 mesh, and thereby Toner 1 was obtained.

Examples 2 to 6

Toner 2 to Toner 6 were obtained in the same manner as Example 1 except that Coalesced Silica a in Example 1 was changed to Coalesced Silica b to Coalesced Silica f, respectively, as the combinations described in Table 2.

Examples 7 to 12

Production of Toner Base Particles B

Toner Base Particles B were obtained in the same manner as the production process of Toner Base Particles A in Example 1 described above except that the mixing time and the aging temperature after the aqueous phase was added in the emulsification and desolvation step were changed to 90 seconds and 48° C., respectively.

<External Addition Treatment>

Toner 7 to Toner 12 were obtained in the same manner as Example 1 except that Coalesced Silica g to Coalesced Silica 1 were added in place of Coalesced Silica a according to the combinations of Table 2 to obtained Toner Base Particles B.

Examples 13 to 17

Production of Toner Base Particles C

Toner Base Particles C were obtained in the same manner as the production process of Toner Base Particles A in Example 1 described above except that the mixing time and the aging temperature after the aqueous phase was added in the emulsification and desolvation step were changed to 40 seconds and 42° C., respectively.

<External Addition Treatment>

Toner 13 to Toner 17 were obtained in the same manner as Example 1 except that Coalesced Silica m to Coalesced Silica q were added to obtained Toner Base Particles C in place of Coalesced Silica a according to the combinations of Table 2.

Example 18

<Production of Toner Base Particles D>

<<Preparation of Solution or Dispersion Liquid of Toner Materials>>

—Synthesis of Non-Crystalline Polyester (Low-Molecular-Weight Polyester) Resin—

A reactor equipped with a cooling tube, a stirrer and a nitrogen inlet tube was charged with 67 parts of 2-mole ethylene-oxide adduct of bisphenol A, 84 parts of 3-mole propylene-oxide adduct of bisphenol A, 274 parts of terephthalic acid, and 2 parts of dibutyltin oxide. It was reacted at a normal pressure and at 230° C. for 8 hours. Next, the reaction solution was reacted at a reduced pressure of 10 mmHg to 15 mmHg for 5 hours, and [Non-Crystalline Polyester 2] was synthesized.

[Non-Crystalline Polyester 2] thus obtained had a number-average molecular weight (Mn) of 2,100, a weight-average molecular weight (Mw) of 5,600, and a glass transition temperature (Tg) of 55° C.

—Preparation of Masterbatch (MB)—

First, 1,000 parts of water, 540 parts of carbon black (PRINTEX35, manufactured by Evonik Degussa) [DBP oil absorption=42 mL/100 mg, pH=9.5], and 1,200 parts of the non-modified polyester were mixed using a HENSCHEL mixer (manufactured by Nippon Coke & Engineering. Co., Ltd.). Then, the mixture was kneaded using a two-roll mill at 150° C. for 30 minutes, rolled and cooled, and then pulverized with a pulverizer (manufactured by Hosokawa Micron Co., Ltd.). Thereby, [Masterbatch 2] was prepared.

—Preparation of Wax-Dispersion Liquid—

A reactor equipped with a stirring rod and a thermometer was charged with 378 parts of [Non-Crystalline Polyester 2], 110 parts of carnauba wax, 22 parts of salicylic acid metal complex E-84 (manufactured by Orient Chemical Industries Co., Ltd.) and 947 parts of ethyl acetate. It was heated to 80° C. with stirring, retained at 80° C. for 5 hours, and then cooled to 30° C. over 1 hour. Next, the reactor was charged with 500 parts of [Masterbatch 2] and 500 parts of ethyl acetate, which was mixed for 1 hour, and thereby [Raw-Material Solution 2] was obtained.

Then, 1,324 parts of obtained [Raw-Material Solution 2] was transferred to a reactor, and using ULTRA VISCO MILL as a bead mill (manufactured by Aimex Co., Ltd.) packed by 80% by volume with 0.5-mm zirconia beads, the carbon black and the carnauba wax were dispersed by running 3 passes under the conditions of a liquid feed rate 1 kg/hr and a peripheral speed of a disk of 6 m/second. Thereby, [Wax Dispersion Liquid 2] was obtained.

—Preparation of Dispersion Liquid of Toner Materials—

Next, 1324 parts of a 65-% by mass ethyl acetate solution of [Non-Crystalline Polyester 2] was added to [Wax Dispersion Liquid 2]. To 200 parts of dispersion liquid obtained by running 1 pass under the above conditions using ULTRA VISCO MILL, 10 part of layered inorganic mineral montmorillonite modified with a quaternary ammonium salt which contains a benzyl group at least at a part thereof (CLAYTON APA, manufactured by Southern Clay Products), which was stirred using a TK HOMODISPER (manufactured by Primix Corporation) for 30 minutes, and [Toner-Material Dispersion Liquid] was obtained.

—Preparation of Aqueous-Medium Phase—

A milky liquid (aqueous phase) was obtained by mixing and stirring 660 parts of water, 25 parts of [Fine-Particle Dispersion Liquid 1] above, 25 parts of 48.5-% aqueous solution of dodecyl diphenyl ether sodium disulfonate (ELEMINOL MON-7, manufactured by Sanyo Chemical Industries, Ltd.), and 60 parts of ethyl acetate. Aggregates of several hundred μm were observed under an optical microscope. This aqueous-medium phase was stirred using a TK HOMOMIXER (manufactured by Primix Corporation) at a rotational speed of 8,000 rpm, and it was confirmed by an optical microscope that the aggregates were loosened and dispersed into small aggregates of several μm.

—Preparation of Emulsion or Dispersion Liquid—

A container was charged with 150 parts of the aqueous-medium phase, and it was stirred using a TK HOMOMIXER (manufactured by Primix Corporation) at a rotational speed of 8,000 rpm. To this, 100 parts of [Toner-Material Dispersion Liquid] above was added and mixed for 60 seconds, and an emulsion or dispersion liquid (Emulsified Slurry 2) was prepared.

—Removal of Organic Solvent—

[Emulsified Slurry 2] was placed in a container equipped with a stirrer and a thermometer and subjected to desolvation at 30° C. for 8 hours. It was then retained at 45° C. for 4 hours, and [Dispersion Slurry 2] was obtained.

—Washing and Drying—

After vacuum filtration of 100 parts of [Dispersion Slurry 2], the following operations were carried out.

(1): To the filter cake, 100 parts of ion-exchanged water was added, which was mixed with TK HOMOMIXER (at a rotational speed of 12,000 rpm for 10 minutes), followed by filtration.

(2): To the filter cake of (1), 100 parts of a 10-% aqueous solution of sodium hydroxide was added, which was mixed with TK HOMOMIXER (at a rotational speed of 12,000 rpm for 30 minutes), followed by vacuum filtration.

(3): To the filter cake of (2), 100 parts of 10-% hydrochloric acid was added, which was mixed with TK HOMOMIXER (at a rotational speed of 12,000 rpm for 10 minutes), followed by filtration.

(4): To the filter cake of (3), 300 parts of ion-exchanged water was added, which was mixed with TK HOMOMIXER (at a rotational speed of 12,000 rpm for 10 minutes), followed by filtration. This operation was repeated twice, and [Filter Cake 2] was obtained.

Thereafter, [Filter Cake 2] was dried in a wind dryer at 45° C. for 48 hours and sieved with a mesh having openings of 75 μm, and Toner Base Particles D were obtained.

<External Addition Treatment>

In a HENSCHEL mixer, 2.0 parts of Coalesced Silica a described in Table 2, 2.0 parts of silica having an average particle diameter of 20 nm, and 0.6 parts of titanium oxide having an average particle diameter of 20 nm were mixed to 100 parts of Toner Base Particles D. It was sieved with a 500 mesh, and thereby Toner 18 was obtained.

Examples 19 to 23

Toner 19 to Toner 23 were obtained in the same manner as Example 18 except that Coalesced Silica a in Example 18 was changed to Coalesced Silica b to Coalesced Silica f, respectively, according to the combinations of Table 2.

Examples 24 to 29

Production of Toner Base Particles E

Toner Base Particles E were obtained in the same manner as the production process of Toner Base Particles D in Example 18 described above except that the mixing time after addition of [Toner-Material Dispersion Liquid] in the preparation step of the emulsion or dispersion liquid was changed to 90 seconds and that the retaining temperature after in the step of removing the organic solvent was changed to 48° C.

<External Addition Treatment>

Toner 24 to Toner 29 were obtained in the same manner as Example 18 except that Coalesced Silica g to Coalesced Silica 1 were added to obtained Toner Base Particles E in place of Coalesced Silica a according to the combinations of Table 2.

Examples 30 to 34

Production of Toner Base Particles F

Toner Base Particles F were obtained in the same manner as the production process of Toner Base Particles D in Example 18 described above except that the mixing time after addition of [Toner-Material Dispersion Liquid] in the preparation step of the emulsion or dispersion liquid was changed to 40 seconds and that the retaining temperature after in the step of removing the organic solvent was changed to 42° C.

<External Addition Treatment>

Toner 30 to Toner 34 were obtained in the same manner as Example 18 except that Coalesced Silica m to Coalesced Silica q were added to obtained Toner Base Particles F in place of Coalesced Silica a according to the combinations of Table 2.

Example 35

Production of Toner Base Particles G

—Preparation of Resin Emulsion—

The following monomers were uniformly mixed, a monomer mixture was prepared.

| | |
|---|---|
| Styrene monomer | 71 parts |
| n-Butyl acrylate | 25 parts |
| Acrylic acid | 4 parts |

The following aqueous mixture was placed in a reactor and heated to 70° C. with stirring. With stirring at a liquid temperature of 70° C., the above monomer mixture and 5 parts of a 1-% aqueous solution of potassium persulfate respectively were simultaneously dropped over 4 hours, and further, it was subjected to polymerization at 70° C. for 2 hours. Thereby, a resin emulsion having a solid content of 50% was obtained.

| | |
|---|---|
| Water | 100 parts |
| Nonionic emulsifier (EMULGEN 950, manufactured by Kao Corporation) | 1 part |
| Anionic emulsifier (NEOGEN R, manufactured by Dai-ichi Kogyo Seiyaku Co., Ltd.) | 1.5 parts |

—Preparation of Toner Particles—

The following mixture was retained at 25° C. using a disper with stirring for 2 hours.

| | |
|---|---|
| Pigment (Carbon black (PRINTEX35, manufactured by Evonik Degussa, DBP oil absorption = 42 mL/100 g, pH = 9.5) | 20 parts |
| Charge controlling agent (E-84, manufactured by Orient Chemical Industries Co., Ltd.) | 1 part |
| Anionic emulsifier (NEOGEN R, manufactured by Dai-ichi Kogyo Seiyaku Co., Ltd.) | 0.5 parts |
| Water | 310 parts |

Next, 188 parts of the above emulsion was added to this dispersion liquid and stirred for about 2 hours. Then, it was heated to 60° C., and a pH thereof was adjusted to 7.0 with ammonia. Further, this dispersion liquid was heated to 90° C. and retained at this temperature for 2 hours, and [Dispersion Slurry 3] was obtained.

After vacuum filtration of 100 parts of [Dispersion Slurry 3], the following operations were carried out.

(1): To the filter cake, 100 parts of ion-exchanged water was added, which was mixed with TK HOMOMIXER (at a rotational speed of 12,000 rpm for 10 minutes), followed by filtration.

(2): To the filter cake of (1), 10-% hydrochloric acid was added to adjust a pH thereof to 2.8, which was mixed with TK HOMOMIXER (at a rotational speed of 12,000 rpm for 10 minutes), followed by vacuum filtration.

(3): To the filter cake of (2), 300 parts of ion-exchanged water was added, which was mixed with TK HOMOMIXER (at a rotational speed of 12,000 rpm for 10 minutes), followed by filtration. This operation was repeated twice, and [Filter Cake 3] was obtained.

Thereafter, [Filter Cake 3] was dried in a wind dryer at 45° C. for 48 hours and sieved with a mesh having openings of 75 μm, and Toner Base Particles G were obtained.

<External Addition Treatment>

In a HENSCHEL mixer, 2.0 parts of Coalesced Silica a described in Table 2, 2.0 parts of silica having an average particle diameter of 20 nm, and 0.6 parts of titanium oxide having an average particle diameter of 20 nm were mixed to 100 parts of Toner Base Particles G. It was sieved with a 500 mesh, and thereby Toner 35 was obtained.

Examples 36 to 40

Toner 36 to Toner 40 were obtained in the same manner as Example 35 except that Coalesced Silica a in Example 35 was changed to Coalesced Silica b to Coalesced Silica f, respectively, according to the combinations of Table 2.

Examples 41 to 46

Production of Toner Base Particles H

Toner Base Particles H were obtained in the same manner as the production process of Toner Base Particles G in Example 35 described above except that the stirring temperature after addition of the emulsion to the dispersion liquid to 55° C. and that the retention time after heating during preparation of the dispersion slurry was changed to 6 hours.

<External Addition Treatment>

Toner 41 to Toner 46 were obtained in the same manner as Example 35 except that Coalesced Silica g to Coalesced Silica I were added to obtained Toner Base Particles H in place of Coalesced Silica a according to the combinations of Table 2.

Examples 47 to 51

Production of Toner Base Particles I

Toner Base Particles I were obtained in the same manner as the production process of Toner Base Particles G in Example 35 described above except that the stirring temperature after the addition of the emulsion to the dispersion liquid was changed to 65° C. and that the heating temperature during preparation of the dispersion slurry was changed to 80° C.

<External Addition Treatment>

Toner 47 to Toner 51 were obtained in the same manner as Example 35 except that Coalesced Silica in to Coalesced Silica q were added to obtained Toner Base Particles I in place of Coalesced Silica a according to the combinations of Table 2.

Comparative Example 1

Production of Toner Base Particles J

Toner Base Particles J were prepared by changing the aging temperature in the emulsification and desolvation step in the production process of [Toner 1] in Example 1 described above was changed to 50° C.

<External Addition Treatment>

Toner 52 was obtained in the same manner as Example 1 except that Coalesced Silica a externally added to the toner base particles was changed to non-coalesced Spherical Silica r (average particle diameter of 120 nm) to obtained Toner Base Particles J according to Table 2.

Comparative Example 2

Toner 53 was obtained in the same manner as Comparative Example 1 except that Spherical Silica r externally added to Toner Base Particles J was changed to Coalesced Silica a as indicated in Table 2.

Comparative Example 3

Toner 54 was obtained in the same manner as Comparative Example 1 except that Spherical Silica r externally added to Toner Base Particles J was changed to Coalesced Silica c as indicated in Table 2.

Comparative Example 4

Toner 55 was obtained in the same manner as Comparative Example 1 except that Spherical Silica r externally added to Toner Base Particles J was changed to Coalesced Silica e as indicated in Table 2.

Comparative Example 5

Toner 56 was obtained in the same manner as Example 1 except that Coalesced Silica a externally added to Toner Base Particles A was changed to Spherical Silica r as indicated in Table 2.

Comparative Example 6

Production of Toner Base Particles L

Toner Base Particles L was prepared by changing the aging temperature in the emulsification and desolvation step in the production process of [Toner 1] in Example 1 described above was changed to 40° C.

<External Addition Treatment>

Toner 57 was obtained in the same mariner as Example 1 except that Toner Base Particles A were changed to Toner Base Particles L and that Coalesced Silica a externally added to the toner base particles was changed to Spherical Silica r.

Comparative Example 7

Toner 58 was obtained in the same manner as Comparative Example 6 except that Spherical Silica r externally added to Toner Base Particles L was changed to Coalesced Silica a as indicated in Table 2.

Comparative Example 8

Toner 59 was obtained in the same manner as Comparative Example 6 except that Spherical Silica r externally added to Toner Base Particles L was changed to Coalesced Silica c as indicated in Table 2.

Comparative Example 9

Toner 60 was obtained in the same manner as Comparative Example 6 except that Spherical Silica r externally added to Toner Base Particles L was changed to Coalesced Silica e as indicated in Table 2.

Comparative Example 10

Toner 61 was obtained in the same manner as Example 30 except that Coalesced Silica m externally added to Toner Base Particles F was changed to Spherical Silica r as indicated in Table 2.

[Evaluation Items]

(Transfer Stability)

A chart with an image area ratio of 20% was transferred from a photoconductor to paper. Then, a transfer residual toner on a photoconductor right before cleaning was transferred to blank paper with a scotch tape (manufactured by Sumitomo 3M Ltd.), which was measured with a Macbeth reflection densitometer RD514 type and evaluated based on the following criteria.

—Evaluation Criteria—

A: A difference from the blank was less than 0.005.

B: A difference from the blank was 0.005 to 0.010.

C: A difference from the blank was 0.011 to 0.02.

D: A difference from the blank exceeded 0.02.

A, B and C were determined as acceptable, and D was determined as unacceptable.

(Filming Evaluation Method)

1. All the toners and apparatuses used for the evaluation were allowed to stand in an environmental chamber of 25° C. and RH 50% for 1 day.

2. A toner in a PCU of a copier was completely removed, leaving only a carrier in a developing apparatus.

3. In the developing apparatus including only the carrier, 28 g of a black toner as a sample was placed, and 400 g of a developer having a toner concentration of 7% was prepared.

4. The developing apparatus was mounted on the copier main body, and only the developing apparatus was run idle for 5 minutes with a linear speed of a developing sleeve (a sleeve which forms a surface of a developing roller) of 300 mm/s.

5. By rotating both the developing sleeve and a photoconductor at an aimed linear velocity with trailing, a charge potential and a developing bias were adjusted such that the toner on the photoconductor was 0.4±0.05 mg/cm$^2$.

6. In the above developing conditions, a transfer current was adjusted so that a transfer rate was 96±2%.

7. Ten thousand (10,000) sheets of a fully solid image were continuously printed out.

8. An image quality of the printed image was subjected to sensory evaluation, and a number of white spots due to filming was counted.

Evaluation criteria of filming property were as follows.

—Evaluation Criteria—

A: Superior with less white-spot portions.

B: White-spot portions were occasionally observed.

C: White-spot portions were noticeable.

D: There were many white-spot portions.

A, B and C were determined as acceptable, and D was determined as unacceptable.

(Low-Temperature Fixing Property)

Using an apparatus that a fixing unit of a copier MF2200 (manufactured by Ricoh Company, Ltd.) using a TEFLON (registered trademark) roller as a fixing roller was remodeled, a copying test was carried out on TYPE 6200 paper (manufactured by Ricoh Company, Ltd.).

Specifically, a cold-offset temperature (minimum fixing temperature) was obtained with a fixing temperature varied.

As evaluation conditions of the minimum fixing temperature, a linear velocity of paper feed was 120 mm/sec to 150 mm/sec, a surface pressure was 1.2 kgf/cm$^2$, and a nip width was 3 mm.

Here, a conventional low-temperature fixing toner has a minimum fixing temperature of around 140° C.

—Evaluation Criteria—

A: The minimum fixing temperature was less than 120° C.

B: The minimum fixing temperature was 120° C. or greater and less than 130° C.

C: The minimum fixing temperature was 130° C. or greater and less than 140° C.

D: The minimum fixing temperature was 140° C. or greater.

A, B and C were determined as acceptable, and D was determined as unacceptable.

(Storage Stability)

A toner was stored at 40° C., RH 70% for 14 days, and it was sieved with a 200 mesh for 1 minute, and a remaining ratio on the mesh was measured.

At this time, a toner having more favorable storage stability in a high-humidity environment has a smaller remaining ratio.

—Evaluation Criteria—

A: The remaining ratio was less than 0.1%.

B: The remaining ratio was 0.1% or greater and less than 0.5%.

C: The remaining ratio was 0.5% or greater and less than 1%.

D: The remaining ratio was 1% or greater.

A, B and C were determined as acceptable, and D was determined as unacceptable.

The evaluation results of produced Toner 1 to Toner 61 are shown in Table 3.

TABLE 2

| | | Toner base particles | | | Coalesced silica | | | | | | |
|---|---|---|---|---|---|---|---|---|---|---|---|
| | Toner name | Toner base particles name | Base vol.-avg. particle diameter (um) | Base BET surface area (m$^2$/g) | Silica | Average secondary particle diameter Dba (nm) | Average value of degree of coalescence G = Db/Da | Number of particles with G <1.3 (number %) | $Db_{10}$ (nm) | $Db_{50}$ (nm) | $Db_{50}/Db_{10}$ |
| Ex. 1 | Toner 1 | A | 5.0 | 3.5 | a | 100 | 2.2 | 6 | 84 | 96 | 1.14 |
| Ex. 2 | Toner 2 | A | 5.0 | 3.5 | b | 85 | 1.7 | 12 | 69 | 82 | 1.19 |
| Ex. 3 | Toner 3 | A | 5.0 | 3.5 | c | 74 | 1.4 | 8 | 60 | 70 | 1.17 |
| Ex. 4 | Toner 4 | A | 5.0 | 3.5 | d | 76 | 3.9 | 16 | 67 | 80 | 1.19 |
| Ex. 5 | Toner 5 | A | 5.0 | 3.5 | e | 213 | 3.7 | 7 | 182 | 206 | 1.13 |
| Ex. 6 | Toner 6 | A | 5.0 | 3.5 | f | 90 | 1.3 | 12 | 71 | 85 | 1.2 |
| Ex. 7 | Toner 7 | B | 4.0 | 2.5 | g | 176 | 1.4 | 7 | 152 | 174 | 1.14 |
| Ex. 8 | Toner 8 | B | 4.0 | 2.5 | h | 92 | 4.2 | 11 | 76 | 90 | 1.18 |
| Ex. 9 | Toner 9 | B | 4.0 | 2.5 | i | 172 | 4.6 | 9 | 148 | 168 | 1.14 |
| Ex. 10 | Toner 10 | B | 4.0 | 2.5 | j | 206 | 4.8 | 12 | 168 | 200 | 1.19 |
| Ex. 11 | Toner 11 | B | 4.0 | 2.5 | k | 192 | 1.7 | 18 | 154 | 188 | 1.22 |
| Ex. 12 | Toner 12 | B | 4.0 | 2.5 | l | 83 | 3.2 | 14 | 65 | 80 | 1.23 |
| Ex. 13 | Toner 13 | C | 6.0 | 5.0 | m | 185 | 3.7 | 20 | 148 | 183 | 1.24 |
| Ex. 14 | Toner 14 | C | 6.0 | 5.0 | n | 81 | 1.6 | 17 | 61 | 77 | 1.26 |
| Ex. 15 | Toner 15 | C | 6.0 | 5.0 | o | 182 | 1.5 | 14 | 144 | 180 | 1.25 |
| Ex. 16 | Toner 16 | C | 6.0 | 5.0 | p | 90 | 3.4 | 17 | 70 | 86 | 1.23 |

TABLE 2-continued

| | | Toner base particles | | | Coalesced silica | | | | | | |
|---|---|---|---|---|---|---|---|---|---|---|---|
| | Toner name | Toner base particles name | Base vol.-avg. particle diameter (um) | Base BET surface area ($m^2/g$) | Silica | Average secondary particle diameter Dba (nm) | Average value of degree of coalescence G = Db/Da | Number of particles with G <1.3 (number %) | $Db_{10}$ (nm) | $Db_{50}$ (nm) | $Db_{50}/Db_{10}$ |
| Ex. 17 | Toner 17 | C | 6.0 | 5.0 | q | 178 | 3.2 | 16 | 144 | 174 | 1.21 |
| Ex. 18 | Toner 18 | D | 5.2 | 3.3 | a | 100 | 2.2 | 6 | 84 | 96 | 1.14 |
| Ex. 19 | Toner 19 | D | 5.2 | 3.3 | b | 85 | 1.7 | 12 | 69 | 82 | 1.19 |
| Ex. 20 | Toner 20 | D | 5.2 | 3.3 | c | 74 | 1.4 | 8 | 60 | 70 | 1.17 |
| Ex. 21 | Toner 21 | D | 5.2 | 3.3 | d | 76 | 3.9 | 16 | 67 | 80 | 1.19 |
| Ex. 22 | Toner 22 | D | 5.2 | 3.3 | e | 213 | 3.7 | 7 | 182 | 206 | 1.13 |
| Ex. 23 | Toner 23 | D | 5.2 | 3.3 | f | 90 | 1.3 | 12 | 71 | 85 | 1.2 |
| Ex. 24 | Toner 24 | E | 4.4 | 2.5 | g | 176 | 1.4 | 7 | 152 | 174 | 1.14 |
| Ex. 25 | Toner 25 | E | 4.4 | 2.5 | h | 92 | 4.2 | 11 | 76 | 90 | 1.18 |
| Ex. 26 | Toner 26 | E | 4.4 | 2.5 | i | 172 | 4.6 | 9 | 148 | 168 | 1.14 |
| Ex. 27 | Toner 27 | E | 4.4 | 2.5 | j | 206 | 4.8 | 12 | 168 | 200 | 1.19 |
| Ex. 28 | Toner 28 | E | 4.4 | 2.5 | k | 192 | 1.7 | 18 | 154 | 188 | 1.22 |
| Ex. 29 | Toner 29 | E | 4.4 | 2.5 | l | 83 | 3.2 | 14 | 65 | 80 | 1.23 |
| Ex. 30 | Toner 30 | F | 6.0 | 4.8 | m | 185 | 3.7 | 20 | 148 | 183 | 1.24 |
| Ex. 31 | Toner 31 | F | 6.0 | 4.8 | n | 81 | 1.6 | 17 | 61 | 77 | 1.26 |
| Ex. 32 | Toner 32 | F | 6.0 | 4.8 | o | 182 | 1.5 | 14 | 144 | 180 | 1.25 |
| Ex. 33 | Toner 33 | F | 6.0 | 4.8 | p | 90 | 3.4 | 17 | 70 | 86 | 1.23 |
| Ex. 34 | Toner 34 | F | 6.0 | 4.8 | q | 178 | 3.2 | 16 | 144 | 174 | 1.21 |
| Ex. 35 | Toner 35 | G | 5.0 | 3.5 | a | 100 | 2.2 | 6 | 84 | 96 | 1.14 |
| Ex. 36 | Toner 36 | G | 5.0 | 3.5 | b | 85 | 1.7 | 12 | 69 | 82 | 1.19 |
| Ex. 37 | Toner 37 | G | 5.0 | 3.5 | c | 74 | 1.4 | 8 | 60 | 70 | 1.17 |
| Ex. 38 | Toner 38 | G | 5.0 | 3.5 | d | 76 | 3.9 | 16 | 67 | 80 | 1.19 |
| Ex. 39 | Toner 39 | G | 5.0 | 3.5 | e | 213 | 3.7 | 7 | 182 | 206 | 1.13 |
| Ex. 40 | Toner 40 | G | 5.0 | 3.5 | f | 90 | 1.3 | 12 | 71 | 85 | 1.2 |
| Ex. 41 | Toner 41 | H | 4.3 | 2.5 | g | 176 | 1.4 | 7 | 152 | 174 | 1.14 |
| Ex. 42 | Toner 42 | H | 4.3 | 2.5 | h | 92 | 4.2 | 11 | 76 | 90 | 1.18 |
| Ex. 43 | Toner 43 | H | 4.3 | 2.5 | i | 172 | 4.6 | 9 | 148 | 168 | 1.14 |
| Ex. 44 | Toner 44 | H | 4.3 | 2.5 | j | 206 | 4.8 | 12 | 168 | 200 | 1.19 |
| Ex. 45 | Toner 45 | H | 4.3 | 2.5 | k | 192 | 1.7 | 18 | 154 | 188 | 1.22 |
| Ex. 46 | Toner 46 | H | 4.3 | 2.5 | l | 83 | 3.2 | 14 | 65 | 80 | 1.23 |
| Ex. 47 | Toner 47 | I | 5.7 | 4.2 | m | 185 | 3.7 | 20 | 148 | 183 | 1.24 |
| Ex. 48 | Toner 48 | I | 5.7 | 4.2 | n | 81 | 1.6 | 17 | 61 | 77 | 1.26 |
| Ex. 49 | Toner 49 | I | 5.7 | 4.2 | o | 182 | 1.5 | 14 | 144 | 180 | 1.25 |
| Ex. 50 | Toner 50 | I | 5.7 | 4.2 | p | 90 | 3.4 | 17 | 70 | 86 | 1.23 |
| Ex. 51 | Toner 51 | I | 5.7 | 4.2 | q | 178 | 3.2 | 16 | 144 | 174 | 1.21 |
| Comp. Ex. 1 | Toner 52 | J | 5.7 | 4.2 | r | | | | | | |
| Comp. Ex. 2 | Toner 53 | J | 4.2 | 2.3 | a | 100 | 2.2 | 6 | 84 | 96 | 1.14 |
| Comp. Ex. 3 | Toner 54 | J | 4.2 | 2.3 | c | 74 | 1.4 | 8 | 60 | 70 | 1.17 |
| Comp. Ex. 4 | Toner 55 | J | 4.2 | 2.3 | e | 213 | 3.7 | 7 | 182 | 206 | 1.13 |
| Comp. Ex. 5 | Toner 56 | A | 5.0 | 3.5 | r | | | | | | |
| Comp. Ex. 6 | Toner 57 | L | 6.4 | 5.2 | r | | | | | | |
| Comp. Ex. 7 | Toner 58 | L | 6.4 | 5.2 | a | 100 | 2.2 | 6 | 84 | 96 | 1.14 |
| Comp. Ex. 8 | Toner 59 | L | 6.4 | 5.2 | c | 74 | 1.4 | 8 | 60 | 70 | 1.17 |
| Comp. Ex. 9 | Toner 60 | L | 6.4 | 5.2 | e | 213 | 3.7 | 7 | 182 | 206 | 1.13 |
| Comp. Ex. 10 | Toner 61 | F | 6.0 | 4.8 | r | | | | | | |

TABLE 3

| | Toner name | Transfer stability | Filming property | Low-temperature fixing property | Storage stability | Overall judgment |
|---|---|---|---|---|---|---|
| Ex. 1 | Toner 1 | A | A | A | A | A |
| Ex. 2 | Toner 2 | A | A | A | A | A |
| Ex. 3 | Toner 3 | A | A | A | A | A |
| Ex. 4 | Toner 4 | A | A | A | A | A |
| Ex. 5 | Toner 5 | A | A | A | A | A |
| Ex. 6 | Toner 6 | B | A | A | C | B |
| Ex. 7 | Toner 7 | A | C | B | A | B |
| Ex. 8 | Toner 8 | A | B | A | B | A |
| Ex. 9 | Toner 9 | B | B | A | B | B |
| Ex. 10 | Toner 10 | C | A | A | B | B |
| Ex. 11 | Toner 11 | B | C | B | A | B |
| Ex. 12 | Toner 12 | B | A | A | B | A |
| Ex. 13 | Toner 13 | B | B | A | C | B |
| Ex. 14 | Toner 14 | B | A | A | C | B |
| Ex. 15 | Toner 15 | B | C | B | B | B |
| Ex. 16 | Toner 16 | C | A | A | C | B |
| Ex. 17 | Toner 17 | C | C | B | B | B |
| Ex. 18 | Toner 18 | A | A | B | B | A |

TABLE 3-continued

| | Toner name | Transfer stability | Filming property | Low-temperature fixing property | Storage stability | Overall judgment |
|---|---|---|---|---|---|---|
| Ex. 19 | Toner 19 | A | A | B | B | A |
| Ex. 20 | Toner 20 | A | A | B | B | A |
| Ex. 21 | Toner 21 | A | A | C | A | A |
| Ex. 22 | Toner 22 | A | A | B | B | A |
| Ex. 23 | Toner 23 | B | A | A | C | B |
| Ex. 24 | Toner 24 | A | C | C | A | B |
| Ex. 25 | Toner 25 | A | B | A | C | B |
| Ex. 26 | Toner 26 | B | B | B | B | B |
| Ex. 27 | Toner 27 | C | A | B | B | B |
| Ex. 28 | Toner 28 | B | C | C | A | B |
| Ex. 29 | Toner 29 | B | A | A | C | B |
| Ex. 30 | Toner 30 | B | B | B | B | B |
| Ex. 31 | Toner 31 | B | A | A | C | B |
| Ex. 32 | Toner 32 | B | C | C | A | B |
| Ex. 33 | Toner 33 | C | A | A | C | B |
| Ex. 34 | Toner 34 | C | C | C | A | B |
| Ex. 35 | Toner 35 | A | A | B | B | A |
| Ex. 36 | Toner 36 | A | A | C | B | B |
| Ex. 37 | Toner 37 | A | A | B | B | A |
| Ex. 38 | Toner 38 | A | A | C | B | B |
| Ex. 39 | Toner 39 | A | A | C | B | B |
| Ex. 40 | Toner 40 | B | A | A | C | B |
| Ex. 41 | Toner 41 | A | C | C | B | B |
| Ex. 42 | Toner 42 | A | B | A | C | B |
| Ex. 43 | Toner 43 | B | B | B | B | B |
| Ex. 44 | Toner 44 | C | A | A | C | B |
| Ex. 45 | Toner 45 | B | C | C | B | B |
| Ex. 46 | Toner 46 | B | A | A | C | B |
| Ex. 47 | Toner 47 | B | B | C | B | B |
| Ex. 48 | Toner 48 | B | A | A | C | B |
| Ex. 49 | Toner 49 | B | C | C | B | B |
| Ex. 50 | Toner 50 | C | A | A | C | B |
| Ex. 51 | Toner 51 | C | C | C | B | B |
| Comp. Ex. 1 | Toner 52 | D | D | A | C | D |
| Comp. Ex. 2 | Toner 53 | C | B | D | A | D |
| Comp. Ex. 3 | Toner 54 | D | C | D | B | D |
| Comp. Ex. 4 | Toner 55 | C | D | B | B | D |
| Comp. Ex. 5 | Toner 56 | D | B | A | C | D |
| Comp. Ex. 6 | Toner 57 | D | D | C | D | D |
| Comp. Ex. 7 | Toner 58 | D | B | B | C | D |
| Comp. Ex. 8 | Toner 59 | B | D | D | B | D |
| Comp. Ex. 9 | Toner 60 | D | B | D | B | D |
| Comp. Ex. 10 | Toner 61 | D | D | B | D | D |

Aspects of the present invention are as follows.

<1> A toner for developing an electrostatic image, including:

toner base particles each including a binder resin and a releasing agent; and inorganic fine particles as an external additive on a surface of the toner base particle, wherein the toner base particles have a BET specific surface area of 2.5 $m^2/g$ to 5.0 $m^2/g$, and wherein the inorganic fine particles include inorganic fine particles (A) which are each a secondary particle where a plurality of primary particles are coalesced together.

<2> The toner for developing an electrostatic image according to <1>, wherein the BET specific surface area of the toner base particles is 3.5 $m^2/g$ to 5.0 $m^2/g$.

<3> The toner for developing an electrostatic image according to <1> or <2>, wherein the inorganic fine particles (A) have $Db_{50}/Db_{10}$ of 1.20 or less, where $Db_{50}$ is a particle diameter at which a cumulative percentage of a secondary particle diameter Db of the inorganic fine particles (A) measured from a side of smaller particles is 50% by number, and $Db_{10}$ is a particle diameter at which the cumulative percentage measured from the side of smaller particles is 10% by number.

<4> The toner for developing an electrostatic image according to any one of <1> to <3>, wherein the inorganic fine particles (A) have an average of degrees of coalescence G of 1.5 to 4.0, where each of the degrees of coalescence is defined as a ratio (Db/Da) with Db being the secondary particle diameter of the inorganic fine particles (A) and Da being an average primary particle diameter of the plurality of primary particles forming the inorganic fine particles (A).

<5> The toner for developing an electrostatic image according to any one of <1> to <4>, wherein a content of the inorganic fine particles (A) having the degree of coalescence G of less than 1.3 in the inorganic fine particles (A) is 10% by number or less.

<6> The toner for developing an electrostatic image according to any one of <1> to <5>, wherein the inorganic fine particles (A) have an average secondary particle diameter Dba of 80 nm to 200 nm.

<7> The toner for developing an electrostatic image according to any one of <1> to <6>, wherein the toner is granulated in an aqueous medium.

<8> The toner for developing an electrostatic image according to any one of <1> to <7>, wherein the toner is obtained by: dispersing an oil phase in an aqueous medium to prepare an emulsified dispersion, the oil phase being obtained by dissolving or dispersing, in an organic solvent, toner materials including a polyester resin, a colorant and a releasing agent; and removing the organic solvent from the emulsified dispersion.

<9> A two-component developer, including:

the toner for developing an electrostatic image according to any one of <1> to <8>; and a carrier.

<10> An image forming apparatus: including:

an electrostatic latent image bearing member;

an electrostatic latent image forming unit which forms an electrostatic latent image on the electrostatic latent image bearing member;

a developing unit which includes the toner for developing an electrostatic image according to any one of <1> to <8> and which forms a visible image by developing the electrostatic latent image with the toner;

a transfer unit which transfers the visible image on the electrostatic latent image bearing member to a recording medium;

a fixing unit which fixes the visible image transferred on the recording medium; and a cleaning unit which removes the toner remaining on the image bearing member.

This application claims priority to Japanese application No. 2012-061685, filed on Mar. 19, 2012 and incorporated herein by reference.

What is claimed is:

1. A toner for developing an electrostatic image, comprising:

toner base particles each comprising a binder resin and a releasing agent; and inorganic fine particles, wherein the toner comprises the inorganic fine particles as an external additive on a surface of the toner base particle, wherein the toner base particles have a BET specific surface area of 2.5 $m^2/g$ to 5.0 $m^2/g$, and wherein the inorganic fine particles comprise inorganic fine silica particles (A) which are each a secondary particle where a plurality of primary particles are coalesced together by chemically bonding, wherein the inorganic fine silica particles (A) have $Db_{50}/Db_{10}$ of 1.20 or less, where $Db_{50}$ is a particle diameter at which a cumulative percentage of a secondary particle diameter Db of the inorganic fine silica particles (A) measured from a side of smaller particles is 50% by number, and $Db_{10}$ is a particle diameter at which the cumulative percentage measured from the side of smaller particles is 10% by number.

2. The toner for developing an electrostatic image according to claim 1, wherein the BET specific surface area of the toner base particles is 3.5 $m^2/g$ to 5.0 $m^2/g$.

3. The toner for developing an electrostatic image according to claim 1, wherein the inorganic fine particles (A) have an average of degrees of coalescence G of 1.5 to 4.0, where each of the degrees of coalescence is defined as a ratio (Db/Da) with Db being the secondary particle diameter of the inorganic fine particles (A) and Da being an average primary particle diameter of the plurality of primary particles forming the inorganic fine particles (A).

4. The toner for developing an electrostatic image according to claim 1, wherein a content of the inorganic fine particles (A) having the degree of coalescence G of less than 1.3 in the inorganic fine particles (A) is 10% by number or less.

5. The toner for developing an electrostatic image according to claim 1, wherein the inorganic fine particles (A) have an average secondary particle diameter Dba of 80 nm to 200 nm.

6. The toner for developing an electrostatic image according to claim 1, wherein the toner is granulated in an aqueous medium.

7. The toner for developing an electrostatic image according to claim 1, wherein the toner is obtained by: dispersing an oil phase in an aqueous medium to prepare an emulsified dispersion, the oil phase being obtained by dissolving or dispersing, in an organic solvent, toner materials comprising a polyester resin, a colorant and a releasing agent; and removing the organic solvent from the emulsified dispersion.

8. A two-component developer, comprising:

a toner for developing an electrostatic image, and a carrier, wherein the toner comprises:

toner base particles each comprising a binder resin and a releasing agent, and inorganic fine particles, wherein the toner comprises the inorganic fine particles as an external additive on a surface of the toner base particle, wherein the toner base particles have a BET specific surface area of 2.5 $m^2/g$ to 5.0 $m^2/g$, and wherein the inorganic fine particles comprise inorganic fine silica particles (A) which are each a secondary particle where a plurality of primary particles are coalesced together by chemically bonding, wherein the inorganic fine silica particles (A) have $Db_{50}/Db_{10}$ of 1.20 or less, where $Db_{50}$ is a particle diameter at which a cumulative percentage of a secondary particle diameter Db of the inorganic fine silica particles (A) measured from a side of smaller particles is 50% by number, and $Db_{10}$ is a particle diameter at which the cumulative percentage measured from the side of smaller particles is 10% by number.

9. An image forming apparatus, comprising:

an electrostatic latent image bearing member;

an electrostatic latent image forming unit which forms an electrostatic latent image on the electrostatic latent image bearing member;

a developing unit which comprises a toner for developing an electrostatic image and which forms a visible image by developing the electrostatic latent image with the toner;

a transfer unit which transfers the visible image on the electrostatic latent image bearing member to a recording medium;

a fixing unit which fixes the visible image transferred on the recording medium; and a cleaning unit which removes the toner remaining on the image bearing member, wherein the toner comprises:

toner base particles each comprising a binder resin and a releasing agent, and inorganic fine particles, wherein the toner comprises the inorganic fine particles as an external additive on a surface of the toner base particle, wherein the toner base particles have a BET specific surface area of 2.5 $m^2/g$ to 5.0 $m^2/g$, and wherein the inorganic fine particles comprise inorganic fine silica particles (A) which are each a secondary particle where a plurality of primary particles are coalesced together by chemically bonding, wherein the inorganic fine silica particles (A) have $Db_{50}/Db_{10}$ of 1.20 or less, where $Db_{50}$ is a particle diameter at which a cumulative percentage of a secondary particle diameter Db of the inorganic fine silica particles (A) measured from a side of smaller particles is 50% by number, and $Db_{10}$ is a particle diameter at which the cumulative percentage measured from the side of smaller particles is 10% by number.

10. The toner for developing an electrostatic image according to claim 1, wherein the inorganic fine silica particles (A) are a plurality of primary particles coalesced together by chemically bonding using a silane-based treating agent or an epoxy-based treating agent.

* * * * *